US010707621B2

(12) United States Patent
Oba et al.

(10) Patent No.: US 10,707,621 B2
(45) Date of Patent: Jul. 7, 2020

(54) CONNECTOR DEVICE AND COAXIAL CONNECTOR

(71) Applicant: SONY CORPORATION, Tokyo (JP)

(72) Inventors: Eiji Oba, Tokyo (JP); Keiichi Nagashiro, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 16/302,780

(22) PCT Filed: May 10, 2017

(86) PCT No.: PCT/JP2017/017667
§ 371 (c)(1),
(2) Date: Nov. 19, 2018

(87) PCT Pub. No.: WO2017/208755
PCT Pub. Date: Dec. 7, 2017

(65) Prior Publication Data

US 2019/0181588 A1 Jun. 13, 2019

(30) Foreign Application Priority Data

Jun. 3, 2016 (JP) ..... 2016-111950

(51) Int. Cl.
*H01R 9/05* (2006.01)
*H01R 13/639* (2006.01)
(Continued)

(52) U.S. Cl.
CPC ..... *H01R 13/639* (2013.01); *H01B 11/18* (2013.01); *H01R 13/42* (2013.01); *H01R 24/38* (2013.01)

(58) Field of Classification Search
CPC ..... H01R 13/639; H01R 13/42; H01R 24/38; H01B 11/18
(Continued)

(56) References Cited

U.S. PATENT DOCUMENTS 5,823,824 A * 10/1998 Mitamura ..... H01R 13/50 439/585
6,142,788 A * 11/2000 Han ..... H01R 24/52 439/63
(Continued)

FOREIGN PATENT DOCUMENTS

EP 1544960 A1 6/2005
JP 2547086 B2 8/1996
(Continued)

OTHER PUBLICATIONS

International Search Report and Written Opinion of PCT Application No. PCT/JP2017/017667, dated Jul. 18, 2017, 09 pages of ISRWO.

*Primary Examiner* — Abdullah A Riyami
*Assistant Examiner* — Nelson R. Burgos-Guntin
(74) *Attorney, Agent, or Firm* — Chip Law Group

(57) ABSTRACT

A connector device according to an embodiment of the present technology includes a first connector and a second connector. The first connector has a plurality of locking groove parts provided on a first peripheral surface thereof and a plurality of unlocking parts provided on the first peripheral surface. The plurality of locking groove parts and the plurality of unlocking parts are arranged in a circumferential direction of the first peripheral surface with a positional displacement from each other. The second connector has a plurality of elastic parts provided on a second peripheral surface fitted into the first peripheral surface and held by the plurality of locking groove parts, respectively. The plurality of elastic parts are configured to be elastically deformable in a radial direction of the second connector body when rotating in a circumferential direction of the second connector body between the plurality of locking groove parts and the plurality of unlocking parts.

14 Claims, 16 Drawing Sheets

(51) Int. Cl.
*H01R 24/38* (2011.01)
*H01B 11/18* (2006.01)
*H01R 13/42* (2006.01)

(58) Field of Classification Search
USPC ..... 439/63, 308, 309, 310, 578, 314, 351, 439/360, 347
See application file for complete search history.

(56) References Cited

U.S. PATENT DOCUMENTS 6,786,767 B1 * 9/2004 Fuks ..... H01R 9/05 439/578
7,416,416 B1 * 8/2008 Hsu ..... H01R 24/44 439/63
8,801,460 B2 * 8/2014 Van Swearingen ..... H01P 5/026 439/578
10,355,436 B2 * 7/2019 Van Swearingen ..... H01R 43/0207
2005/0136701 A1 6/2005 Ikeda
2005/0181652 A1 * 8/2005 Montena ..... H01R 13/5205 439/271
2010/0041271 A1 * 2/2010 Van Swearingen ..... B29C 45/14639 439/583
2012/0129375 A1 * 5/2012 Van Swearingen ..... H01R 9/05 439/314
2015/0229070 A1 * 8/2015 Van Swearingen ..... H04B 5/0012 439/320
2019/0148867 A1 * 5/2019 Saeki ..... H01R 13/187 439/474

FOREIGN PATENT DOCUMENTS

JP 2547086 B2 10/1996
JP 2547086 Y2 9/1997
JP 2000-228850 A 8/2000
JP 2005-183212 A 7/2005
JP 2006-147458 A 6/2006
JP 2005-183212 A 7/2015

* cited by examiner

CONNECTOR DEVICE AND COAXIAL CONNECTOR

CROSS REFERENCE TO RELATED APPLICATIONS

This application is a U.S. National Phase of International Patent Application No. PCT/JP2017/017667 filed on May 10, 2017, which claims priority benefit of Japanese Patent Application No. JP 2016-111950 filed in the Japan Patent Office on Jun. 3, 2016. Each of the above-referenced applications is hereby incorporated herein by reference in its entirety.

TECHNICAL FIELD

The present technology relates to a connector device and a coaxial connector used to connect, for example, a cable and an electronic apparatus to each other.

BACKGROUND ART

Coaxial connectors have been widely used to connect, for example, coaxial cables and electronic apparatuses to each other. Such coaxial connectors are required to have a structure in which connection is facilitated and a predetermined level or more of an extracting force can be ensured. As a structure for ensuring the extracting force of a coaxial connector, a technology such as fastening a plug part with a rotating screw or locking the same with a rotating mechanism has been known. For example, Patent Literature 1 discloses a technology that is provided with an end holding member rotating about a shaft in conjunction with the extracting operation of a connector and a curved plate spring capable of being bent inward in a radial direction in conjunction with the rotation of the end holding member, and that surface-pressurizes a counter-side connector with the curved plate spring from an outward in the radial direction to maintain a connected state.

CITATION LIST

Patent Literature

Patent Literature 1: Japanese Patent Application Laid-open No. 2006-147458

DISCLOSURE OF INVENTION

Technical Problem

However, conventional coaxial connectors include many components and thus cause problems such as the complexity and the upsizing of structures. In recent years, the development of connector structures that allow miniaturization with a simple configuration and can reduce an extraction operating force has been demanded.

In view of the above circumstances, it is an object of the present technology to provide a connector device and a coaxial connector that allow miniaturization with a simple configuration and can reduce an extraction operating force.

Solution to Problem

A connector device according to an embodiment of the present technology includes a first connector and a second connector.

The first connector has a first connector body having a first peripheral surface, a plurality of locking groove parts provided on the first peripheral surface, and a plurality of unlocking parts provided on the first peripheral surface. The plurality of locking groove parts and the plurality of unlocking parts are arranged in a circumferential direction of the first peripheral surface with a positional displacement from each other.

The second connector has a second connector body and a plurality of elastic parts. The second connector body has a second peripheral surface and is fitted into the first connector body. The plurality of elastic parts are provided on the second peripheral surface and held by the plurality of locking groove parts, respectively. The plurality of elastic parts are configured to be elastically deformable in a radial direction of the second connector body when rotating in a circumferential direction of the second connector body between the plurality of locking groove parts and the plurality of unlocking parts.

In the connector device, locking and unlocking are realizable by the relative rotating operation between the first and second connectors, and it becomes possible to achieve a reduction in an operating force since a locking mechanism is scattered in a rotating direction. Thus, according to the connector device, the simplification and miniaturization of a configuration can be achieved.

The first connector body may be constituted by a cylindrical body. The cylindrical body has the first peripheral surface as an outer peripheral surface and is coaxially attached to the second connector body.

The cylindrical body may have a first end including a guiding surface provided adjacent to the plurality of unlocking parts in an axis direction. The guiding surface has a tapered shape with which the plurality of elastic parts are elastically deformed when the first connector body is attached to the second connector body in the axis direction.

Thus, the attachability of both the connectors is enhanced.

According to the configuration, the guiding surface may have a plurality of positioning parts that position the plurality of elastic pieces in the circumferential direction.

The plurality of locking groove parts may be configured to allow movement of the plurality of elastic parts in the circumferential direction and restrict movement of the plurality of elastic parts in the axis direction.

Thus, the connectors can be locked and unlocked regardless of their rotating directions.

The plurality of elastic parts may have respective engaging claws that engage the plurality of locking groove parts.

The second connector may have an elastic member attached to the second peripheral surface, and the plurality of elastic parts may be constituted by a part of the elastic member.

The cylindrical body may further have a second end on a side thereof opposite to the first end. In this case, the first connector further has a flat-shaped seating part that supports the second end.

The second connector may further have a cable insertion part and a protrusion part. The cable insertion part protrudes outward in the radial direction from the second connector body. The protrusion part protrudes from the second connector body in a direction opposite to a protruding direction of the cable insertion part, and has an opposed surface opposed to the seating part.

The connector device may further include a coaxial signal line provided inside the cylindrical body. The coaxial signal line has a metal annular shielding body, a shaft-shaped terminal, and a resin member. The annular shielding body has a first edge part and a second edge part opposed to the first edge part in the circumferential direction, and has a plurality of penetration holes formed on a peripheral surface thereof. The shaft-shaped terminal is arranged at an axis part of the annular shielding body. The resin member is filled in the cylindrical body, and integrally fixes the annular shielding body and the shaft-shaped terminal together.

The first edge part may have a projection part that protrudes toward the second edge part, the second edge part may have a recess part that accommodates the projection part, and the annular shielding body may further have an opening part. The opening part is provided between the projection part and the recess part and filled with a part of the resin member.

The annular shielding body may further have a connection end that is opposed to the seating part and a plurality of terminal parts that protrude in the axis direction from the connection end and are provided at intervals in the circumferential direction.

In this case, the first connector further has a shielding structure that is fixed to the seating part and has a plurality of engaging parts that engage the plurality of terminal parts.

A coaxial connector according to an embodiment of the present technology is a coaxial connector configured to be capable of being inserted into and extracted from a counter-side connector having a plurality of elastic parts provided along a circumferential direction of an inner peripheral surface thereof. The coaxial connector includes a connector body.

The connector body has a cylindrical body, a plurality of locking groove parts, and a plurality of unlocking parts.

The cylindrical body has an outer peripheral surface capable of being fitted into the inner peripheral surface. The plurality of locking groove parts are provided on the outer peripheral surface and configured to be capable of holding the plurality of elastic parts. The plurality of unlocking parts are provided on the outer peripheral surface.

The plurality of locking groove parts and the plurality of unlocking parts are arranged in a circumferential direction of the outer peripheral surface with a positional displacement from each other, and are configured to allow the plurality of elastic parts to be elastically deformed in a radial direction of the cylindrical body when rotating in the circumferential direction of the cylindrical body between the plurality of locking groove parts and the plurality of unlocking parts.

A coaxial connector according to another embodiment of the present technology is a coaxial connector configured to be capable of being inserted into and extracted from a counter-side connecter in which a plurality of locking groove parts and a plurality of unlocking parts are arranged in a circumferential direction of an outer peripheral surface with a positional displacement from each other. The coaxial connector includes a connector body.

The connector body has a cylindrical body and a plurality of elastic parts. The cylindrical body has an inner peripheral surface capable of being fitted into the outer peripheral surface. The plurality of elastic parts are provided on the inner peripheral surface and held by the plurality of locking groove parts, respectively.

The plurality of elastic parts are configured to be elastically deformable in a radial direction of the cylindrical body when rotating in a circumferential direction of the cylindrical body between the plurality of locking groove parts and the plurality of unlocking parts.

Advantageous Effects of Invention

As described above, the present technology allows miniaturization with a simple configuration and can reduce an extraction operating force.

Note that the effects described here are not limitative and any effect described in the present disclosure may be produced.

MODE(S) FOR CARRYING OUT THE INVENTION

Hereinafter, embodiments according to the present technology will be described with reference to the drawings.

First Embodiment

Figure 1:
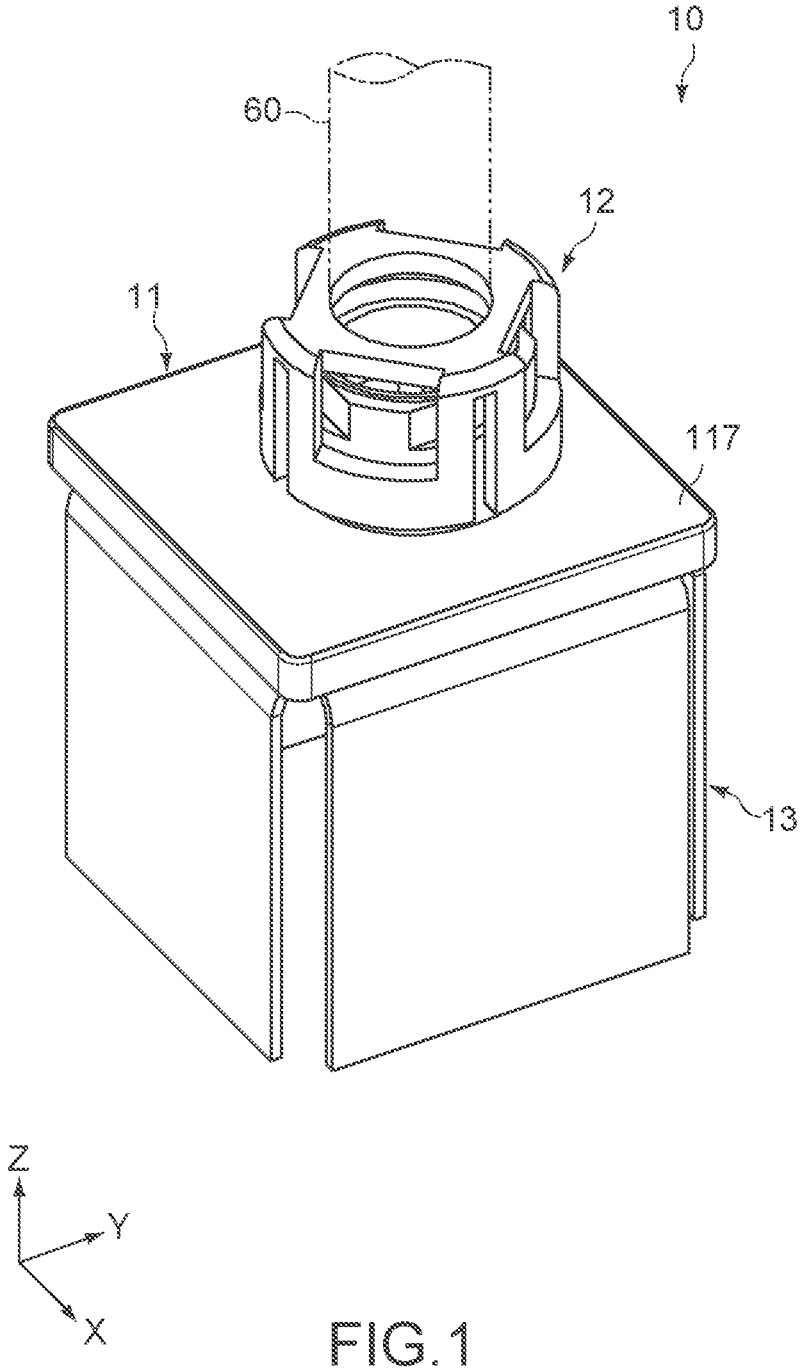
FIG. 1 is an entire perspective view of a connector device according to a first embodiment of the present technology.
Figure 2:
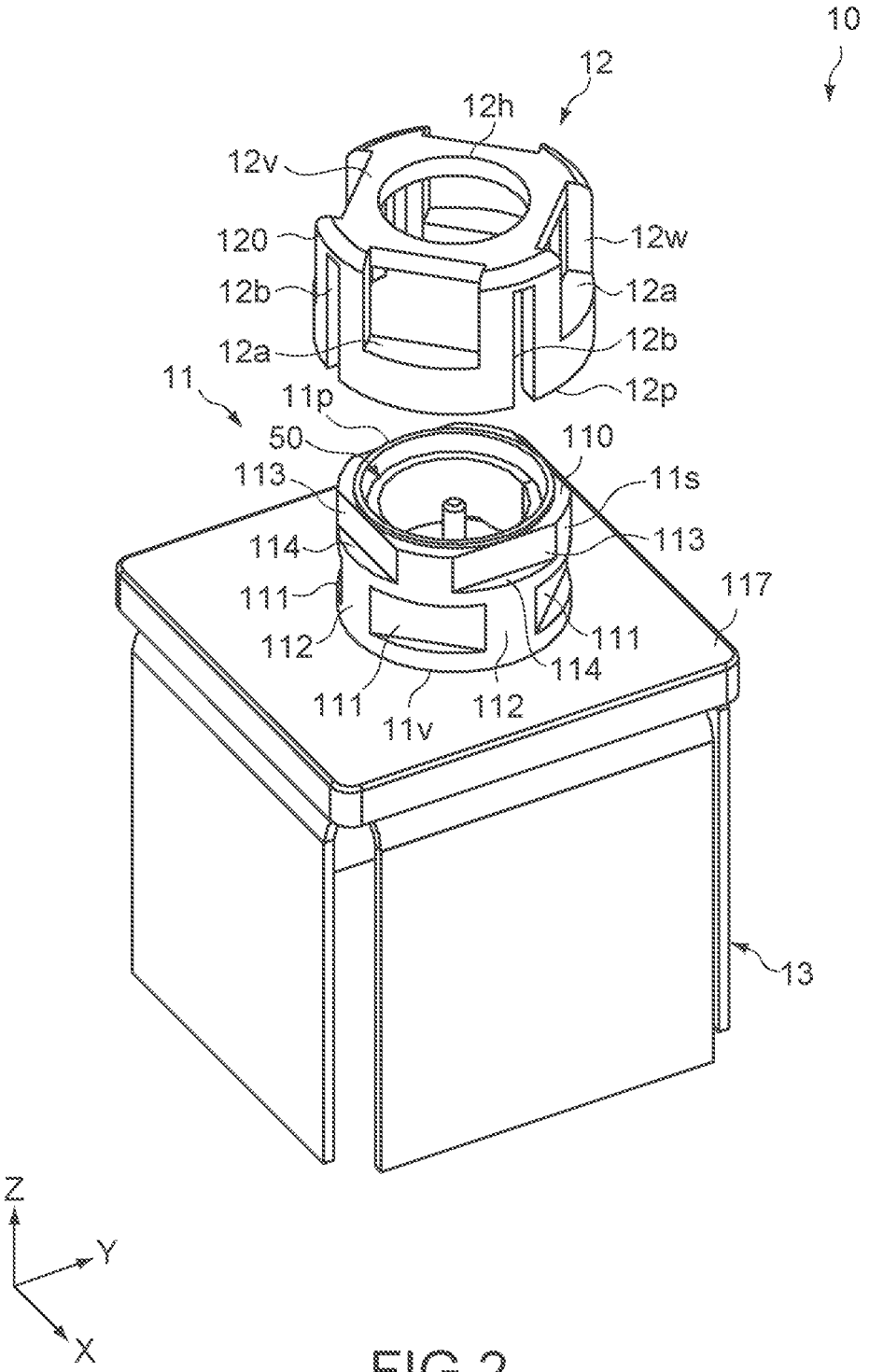
FIG. 2 is an exploded perspective view of the connector device.
Figure 3:
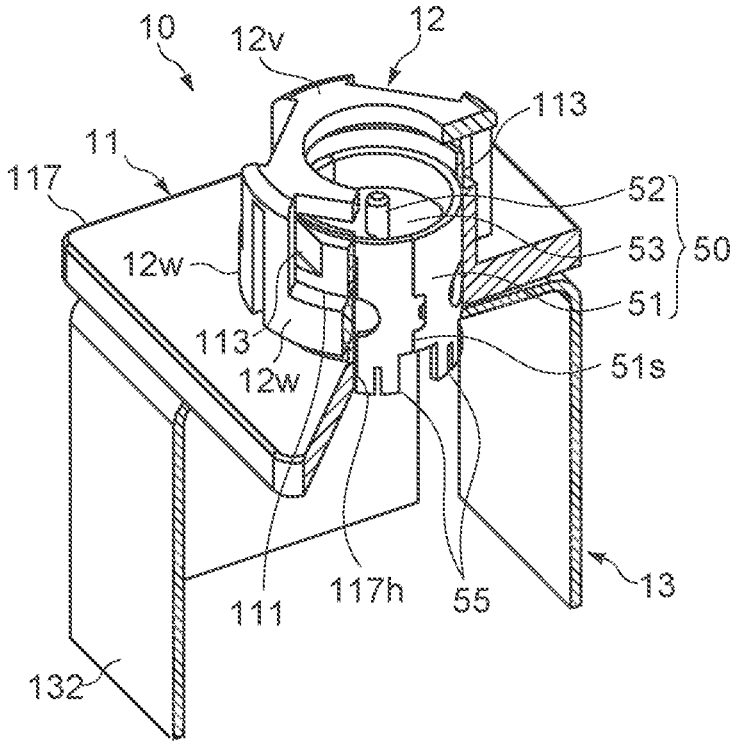
FIG. 3 is a vertical cross-sectional view of the substantial part of the connector device.
Figure 4:
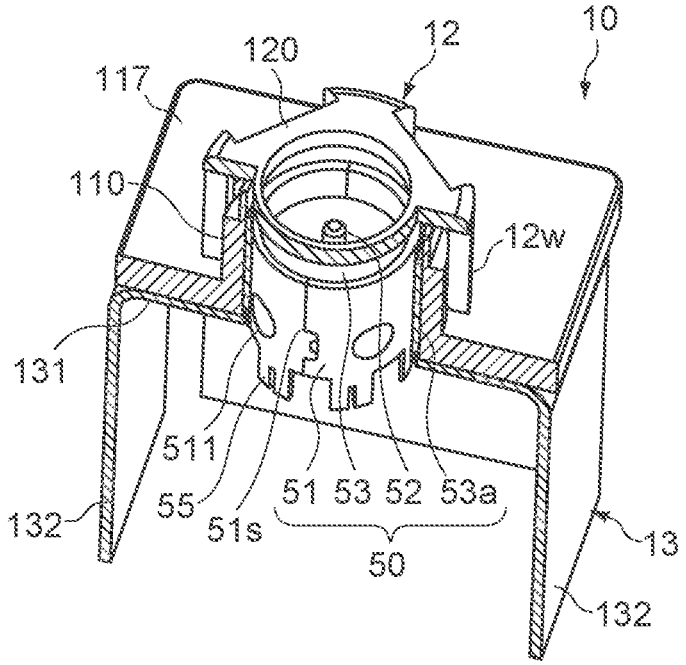
FIG. 4 is a vertical cross-sectional view of the substantial-part of the connector device.
Figure 5:
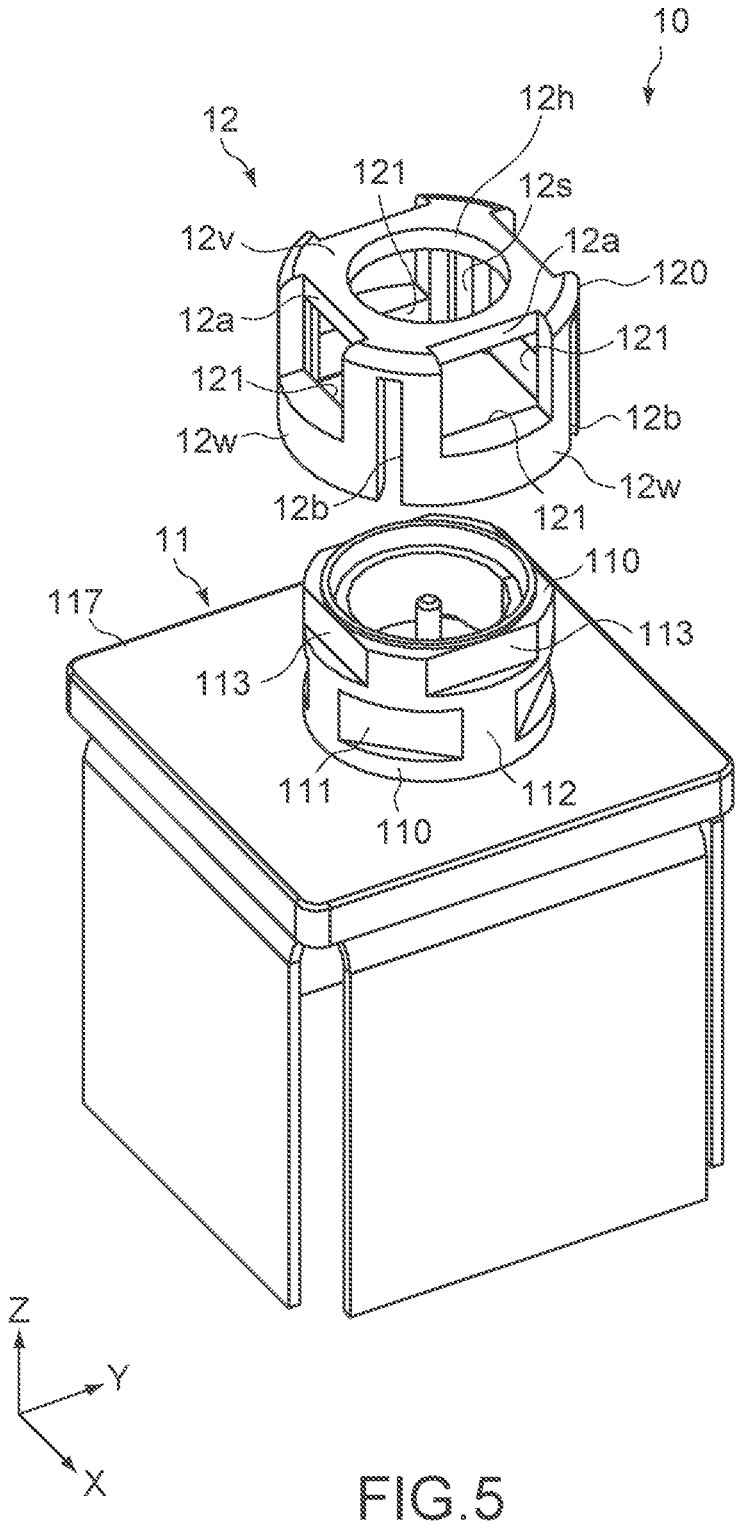
FIG. 5 is a perspective view for describing a procedure for attaching and detaching the connector device.
Figure 6:
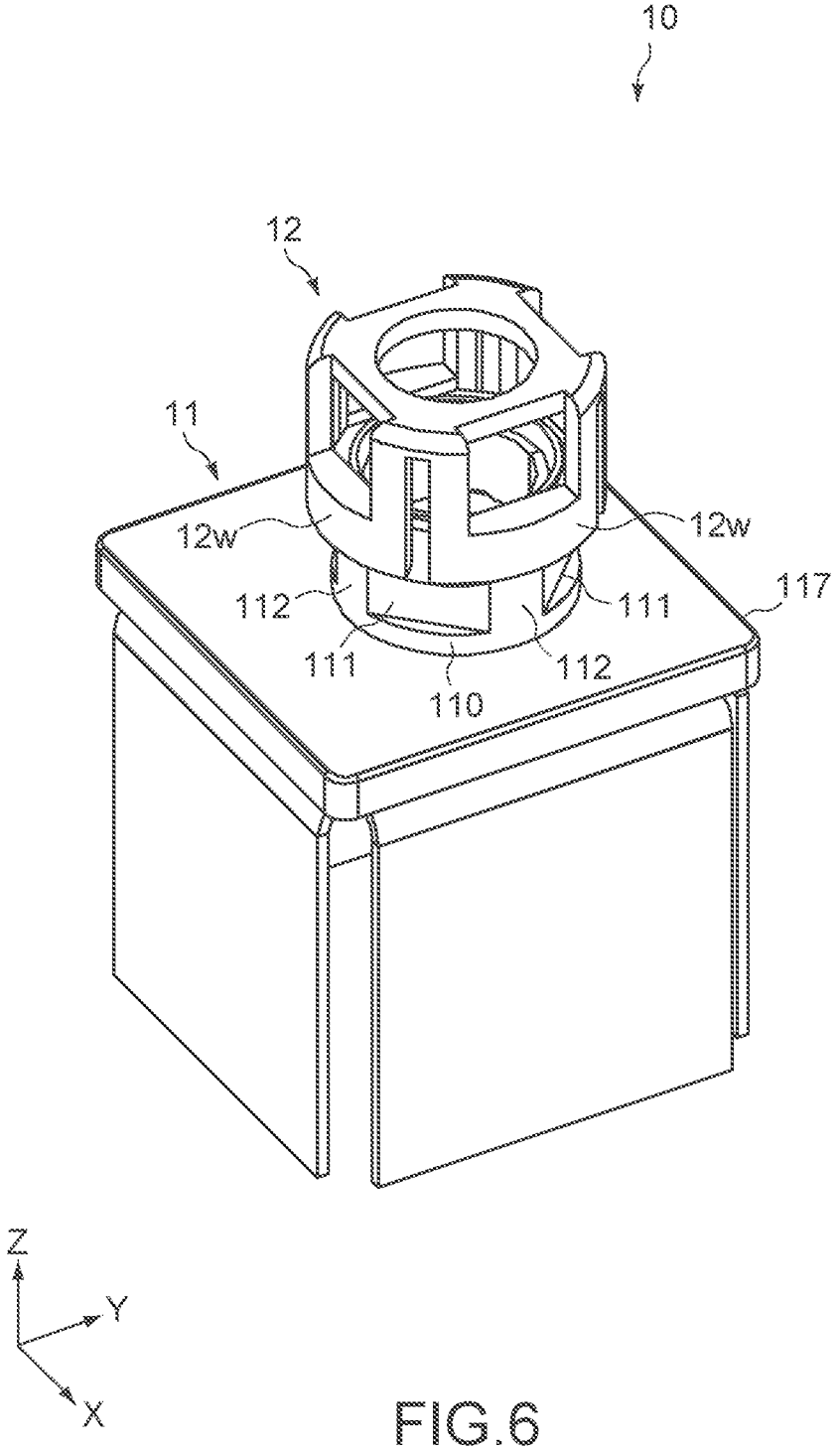
FIG. 6 is a perspective view for describing the procedure for attaching and detaching the connector device.

FIG. 1 is an entire perspective view of a connector device according to a first embodiment of the present technology, FIG. 2 is an exploded perspective view of the connector device, FIGS. 3 and 4 are cross-sectional views of the substantial part of the connector device, and FIGS. 5 and 6 are perspective views for describing a procedure for attaching and detaching the connector device. In the respective figures, an X-axis, a Y-axis, and a Z-axis indicate three axial directions orthogonal to each other.

[Connector Device]

A connector device 10 according to the present embodiment includes a first connector 11 and a second connector 12.

Each of the first connector 11 and the second connector 12 is configured as a coaxial connector capable of being mutually inserted and extracted in a Z-axis direction. In the present embodiment, the first connector 11 corresponds to a jack provided on the side of an apparatus, and the second connector 12 corresponds to a plug attached to the tip end of a coaxial cable 60.

(First Connector)

As shown in FIG. 2, the first connector 11 includes a cylindrical body 110 (first connector body), a plurality of locking groove parts 111, and a plurality of unlocking parts 112.

The cylindrical body 110 is typically constituted by an injection molded body made of a synthetic resin material and includes an outer peripheral surface 11*s* coaxially attached to a cylindrical body 120 of the second connector 12. The cylindrical body 110 is formed into a substantially cylindrical shape having an axis (central axis) parallel to the Z-axis direction. A tip end 11*p* of the cylindrical body 110 is opposed to the second connector 12, and a base end 11*v* of the cylindrical body 110 is fixed to a seating part 117 that will be described later. The cylindrical body 110 has a shape rotationally symmetric about the central axis.

The plurality of locking groove parts 111 are provided at intervals in a circumferential direction on the same circumference of the outer peripheral surface 11*s* of the cylindrical body 110. Each of the plurality of locking groove parts 111 has the same configuration and is constituted by a groove part having a rectangular opening shape obtained by cutting off a part of the outer peripheral surface 11*s* in the circumferential direction (tangential line direction) orthogonal to a radial direction. The plurality of locking groove parts 111 are provided on the outer peripheral surface 11*s* on the side of the base end 11*v* of the cylindrical body 110.

In the present embodiment, the respective locking groove parts 111 are provided at an interval of 90° in the circumferential direction of the outer peripheral surface 11*s*. The respective locking groove parts 111 have the rectangular opening shape long in the circumferential direction. The bottom part of the respective locking groove parts 111 is formed of a plane surface but may be formed of a curved surface (arc surface). The maximum depth of the respective locking groove parts 111 is not particularly limited but is formed in a size at which a predetermined level or more of an extracting force with respect to the second connector 12 can be ensured.

The plurality of unlocking parts 112 are also provided at intervals in the circumferential direction on the same circumference of the outer peripheral surface 11*s* of the cylindrical body 110. Each of the plurality of unlocking parts 112 has the same configuration and is provided between the plurality of locking groove parts 111 at an interval of 90° in the circumferential direction of the outer peripheral surface 11*s*. Thus, the locking groove parts 111 and the unlocking parts 112 are arranged in the circumferential direction of the outer peripheral surface 11*s* with a positional displacement from each other (the locking groove parts 111 and the unlocking parts 112 are alternately arranged in the circumferential direction).

The respective unlocking parts 112 are constituted by partial cylindrical surfaces forming the outer diameter of the cylindrical body 110, the outer diameter being greater than that of the respective locking groove parts 111. The unlocking parts 112 have the function of elastically deforming a tip end 12*p* (elastic parts 121) of the second connector 12 attached to the cylindrical body 110 outward in a radial direction as will be described later.

The first connector 11 further includes a plurality of positioning parts 113. The plurality of positioning parts 113 are provided at intervals in the circumferential direction on the same circumference of the outer peripheral surface 11*s* of the cylindrical body 110. The plurality of positioning parts 113 are provided on the outer peripheral surface 11*s* on the side of the tip end 11*p* of the cylindrical body 110.

Each of the plurality of positioning parts 113 has the same configuration and is constituted by a notch part obtained by cutting off a part of the outer peripheral surface 11*s* in the circumferential direction (tangential line direction) orthogonal to the radial direction. The respective positioning parts 113 are opened on their sides close to the tip end 11*p* (first end) of the cylindrical body 110 and configured to be capable of being fitted into the tip end 12*p* of the second connector 12. That is, the respective positioning parts 113 are used to position the second connector 12 in the circumferential direction with respect to the first connector 11 when the first connector 11 and the second connector 12 are bonded together.

The respective positioning parts 113 are provided to be opposed to the plurality of unlocking parts 112 in the axis direction (Z-axis direction) at an interval of 90° in the circumferential direction of the outer peripheral surface 11*s*. The respective positioning parts 113 have a rectangular opening shape long in the circumferential direction. The bottom part of the respective positioning parts 113 is formed of a plane surface but may be formed of a curved surface (arc surface). The maximum depth of the respective positioning parts 113 is not particularly limited but is formed in an appropriate size at which the tip end 12*p* of the second connector 12 is capable of being fitted and a predetermined positioning function is obtained. The respective positioning parts 113 constitute guiding surfaces provided adjacent to the plurality of unlocking parts 112 in the axis direction.

Guiding parts 114 are provided between the plurality of unlocking parts 112 and the plurality of positioning parts 113. Each of the plurality of guiding parts 114 has the same configuration and is constituted by a step part formed between the unlocking part 112 and the positioning part 113. The respective guiding parts 114 are constituted by appropriate plane surfaces, tapered surfaces, or curved surfaces allowing the tip end 12*p* of the second connector 12 attached to the positioning parts 113 to be guided to the unlocking parts 112.

The first connector 11 further includes the seating part 117 that supports the base end 11*v* (second end) of the cylindrical body 110. The seating part 117 is made of a synthetic resin material and typically integrally formed with the cylindrical body 110. The seating part 117 has a rectangular flat plate shape, but its shape is not particularly limited. A circular shape or any geometrical shape is employable as such. The seating part 117 functions as a base for fixing the first connector 11 to the side of an apparatus. Thus, the attitude of the cylindrical body 110 can be stably held.

Note that a metal shielding structure 13 is integrally bonded to the lower surface (surface on a side opposite to the cylindrical body 110) of the seating part 117 (see FIGS. 3 and 4). As will be described later, the shielding structure 13 is bonded to a coaxial signal line 50 and has a housing structure that coats the surrounding of an electronic apparatus (not shown) electrically connected to the coaxial signal line 50. As the electronic apparatus, in the present embodiment, a camera accessory (image capturing apparatus) is used, and an in-vehicle camera accessory is more specifically employed.

(Second Connector)

Meanwhile, the second connector 12 includes a cylindrical body 120 (second connector body) and a plurality of elastic parts 121.

The cylindrical body 120 is typically constituted by an injection molded body made of a synthetic resin material but is not limited to the same. The cylindrical body 120 may be made of a metal material. The cylindrical body 120 is formed into a substantially cylindrical shape having an axis (central axis) parallel to the Z-axis direction. The tip end 12*p* of the cylindrical body 120 is opposed to the first connector 11, and a base end 12*v* of the cylindrical body 120 has a penetration hole 12*h* where the coaxial cable 60 penetrates. The second connector 12 is rotatably attached in the circumferential direction with respect to the tip end of the coaxial cable 60.

A plurality of slit parts 12*b* are provided on the cylindrical body 120 from the tip end 12*p* to the base end 12*v* of the cylindrical body 120, whereby the peripheral wall of the cylindrical body 120 is divided into a plurality of peripheral wall parts 12*w*. In the present embodiment, the slit parts 12*b* are arranged at an interval of 90° in the circumferential direction of the cylindrical body 120, whereby the four peripheral wall parts 12*w* are formed. The respective peripheral wall parts 12*w* have a rectangular opening part 12*a* penetrating in their radial direction.

An inner peripheral surface 12*s* of the cylindrical body 120 is configured to be capable of being fitted into the outer peripheral surface 11*s* of the cylindrical body 110 of the first connector 11. The inner peripheral surface 12*s* is formed into a plane shape, and the opening shape of the inner peripheral surface 12*s* when seen from the tip end 12*p* is formed into a substantially square shape. The opening shape nearly matches an outer shape constituted by the plurality of positioning parts 113 when seen from the tip end 11*p* of the first connector 11.

The plurality of elastic parts 121 are provided at intervals in a circumferential direction on the same circumference of the inner peripheral surface 12*s* of the cylindrical body 120 (see FIG. 5). Each of the plurality of elastic parts 121 has the same configuration. In the present embodiment, the plurality of elastic parts 121 are constituted by inner peripheral surfaces on the side of the tip end 12*p* of the respective peripheral wall parts 12*w*. The respective elastic parts 121 constitute engaging claws capable of being held by (or engaging) the respective locking groove parts 111 of the first connector 11.

The relative movement of the respective elastic parts 121 in the axis direction (Z-axis direction) is restricted by the respective locking groove parts 111, but the relative movement of the respective elastic parts 121 in the circumferential direction (about the Z-axis) is allowed. The respective elastic parts 121 are configured to be elastically deformable in the radial direction of the cylindrical body 120 when the cylindrical body 120 rotates in the circumferential direction between the locking groove parts 111 and the unlocking parts 112. At this time, the respective elastic parts 121 are elastically deformed in the radial direction independently from each other with the slit parts 12*b* as boundaries.

(Method of Attaching and Detaching Connectors)

In bonding the first and second connectors 11 and 12 together, both the connectors 11 and 12 are first opposed to each other so that the respective positioning parts 113 of the first connector 11 and the respective peripheral wall parts 12*w* (the elastic parts 121) of the second connector 12 are aligned with each other in the axis direction as shown in FIG. 5.

Subsequently, as shown in FIG. 6, the respective peripheral wall parts 12*w* (the elastic parts 121) of the second connector 12 are fitted into the respective positioning parts 113 of the first connector 11. After that, as the second connector 12 is pushed forward in the axis direction, the respective peripheral wall parts 12*w* run onto the respective unlocking parts 112 while being elastically deformed outward in the radial direction. Then, the second connector 12 is rotated by 45° in the circumferential direction (about the Z-axis) with respect to the first connector 11 to move the inner surfaces (the elastic parts 121) of the respective peripheral wall parts 12*w* to the respective locking groove parts 111 of the first connector 11 (FIG. 1). Along with the rotating operation, the respective elastic parts 121 are elastically restored inward in the radial direction and engage the respective locking groove parts 111 (FIG. 3). Thus, the first and second connectors 11 and 12 are connected to each other. At the same time, the coaxial signal line 50 and the coaxial cable 60 are electrically connected to each other although not shown in the figures.

On the other hand, the above operation is performed in an inverse order in separating the first and second connectors 11 and 12 from each other. That is, the second connector 12 is rotated by 45° in the circumferential direction with respect to the first connector 11 from a state shown in FIG. 1 to move the respective peripheral wall parts 12*w* of the second connector 12 to the unlocking parts 112 of the first connector 111. Along with the rotating operation, the respective elastic parts 121 are elastically deformed outward in the radial direction. After that, the second connector 12 is extracted in the axis direction from the first connector 11, whereby the connection between the coaxial signal line 50 and the coaxial cable 60 is cancelled and both the connectors 11 and 12 are separated from each other (FIG. 5).

As described above, in the present embodiment, the insertion and extraction of both the connectors 11 and 12 are performed in two actions including the relative movement of the second connector 12 in the axis direction and the relative movement of the second connector 12 in the circumferential direction with respect to the first connector 11.

According to the present embodiment, the locking and unlocking of the first and second connectors 11 and 12 can be realized by the relative rotating operations between the first and second connectors 11 and 12. Particularly, since a locking mechanism constituted by the locking groove parts 111 and the elastic parts 121 is arranged to be axially symmetric, a uniform locking state can be ensured in the circumferential direction while the simplification and miniaturization of a configuration are achieved.

In addition, since the locking mechanism is scattered in the circumferential direction, a rotating operation force required to perform the locking and unlocking can be reduced. Moreover, since a rotating direction in locking and unlocking operations is not restricted, inserting and extracting operability is improved. Further, since a certain clicking feeling through the elastic parts 121 is obtained in a rotating operation from an unlocking position to a locking position, the locking position can be easily confirmed. Furthermore, a desired extracting force can be easily ensured by the adjustment of the depth or the like of the locking groove parts 111.

[Coaxial Signal Line]

Subsequently, the coaxial signal line 50 accommodated inside the cylindrical body 110 of the first connector 11 will be described.

As shown in FIGS. 3 and 4, the coaxial signal line 50 is integrally fixed inside the cylindrical body 110. The coaxial signal line 50 is connected to an electronic apparatus such as a camera and constitutes the electrical contact between the electronic apparatus and the coaxial cable 60.

The coaxial signal line 50 includes a metal annular shielding body 51, a shaft-shaped terminal 52, and a resin material 53. As will be described later, the resin material 53 is desirably a material selected for the impedance matching of a coaxial signal.

The annular shielding body 51 is electrically connected to the shielding line of the coaxial shield 60 when the connectors 11 and 12 are bonded together. The shaft-shaped terminal 52 is arranged at the axis part of the annular shielding body 51 and electrically connected to the signal line of the coaxial shield 60. The resin material 53 is filled between the annular shielding body 51 and the shaft-shaped terminal 52 and made of an electrical insulating synthetic resin material having a predetermined dielectric constant. The resin material 53 is formed into a substantially cylindrical shape so as to coat a predetermined region other than both ends of the annular shielding body 51, and both ends of the shaft-shaped terminal 52 protrude outward from central parts at both end surfaces of the resin material 53.

Here, a coaxial signal line generally requires a predetermined waterproofing structure. Therefore, the coaxial signal line is required to be integrally molded by metal and a resin as described above and ensure airtightness at the interface between the metal and the resin.

In the present embodiment, predetermined surface treatment for enhancing an affinity for a resin is applied to the surface of the annular shielding body 51 to increase the adhesion between the annular shielding body 51 and the resin material 53. In addition, a plurality of penetration holes 511 for pouring a resin constituting the resin material 53 are provided on the peripheral surface of the annular shielding body 51 from its inner peripheral side to outer peripheral side. Thus, the contact interface length between the annular shielding body 51 and the resin material 53 is ensured, and the adhesion reliability between the annular shielding body 51 and the resin material 53 is ensured.

The opening size of the penetration holes 511 is not particularly limited but may be appropriately set. Generally, as the opening size is greater, the flow speed of the resin is ensured during molding, whereby the adhesion between the annular shielding body 51 and the resin material 53 is enhanced during the molding. On the other hand, as the opening size is smaller, the effect of shielding a high frequency noise having a specific wavelength or more is easily obtained. Therefore, the opening size is determined on the basis of a minimum size at which molding stability associated with the molding is ensured and an electronic frequency aiming for electronic shielding.

Note that a part of the resin material 53 coating the outer peripheral surface of the annular shielding body 51 is constituted as a bonding part 53*a* that bonds the annular shielding body 51 and the inner peripheral part of the cylindrical body 110 to each other (FIG. 4).

On the other hand, the annular shielding body 51 is constituted by the combined body of one or a plurality of plate materials folded into an arc shape. Accordingly, at least a part of the peripheral surface of the annular shielding body 51 has seam parts (joint lines). Since the seam parts have a slight gap, the resin material constituting the resin material 53 hardly flows through the seam parts. Therefore, the seam parts are entirely communicated, which causes the leakage of airtightness or a degradation in waterproofing properties.

Figure 7:
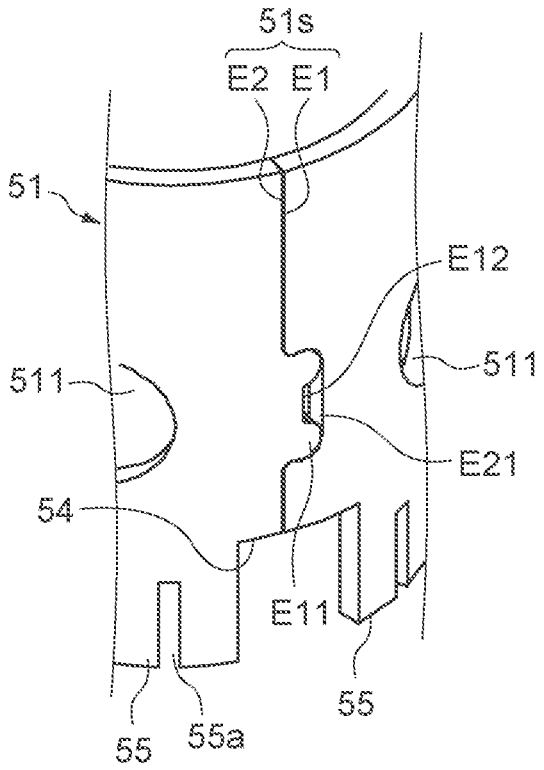
FIG. 7 is an enlarged perspective view of the substantial part in FIG. 3.

Therefore, in the present embodiment, the annular shielding body 51 is configured as follows to ensure the airtightness of the seam parts. FIG. 7 is a substantial-part enlarged perspective view showing the configuration of a seam part 51*s* of the annular shielding body 51.

As shown in FIG. 7, the seam part 51*s* is constituted by the boundary part between a first edge part E1 and a second edge part E2 opposed to the first edge part E1 in the circumferential direction. The first edge part E1 includes a projection part E11 that protrudes toward the second edge part E2. The second edge part E2 includes a recess part E21 that accommodates the projection part E11 having a bump in its tip end direction. The recess part E21 has a shape spreading toward its depth. Further, the plate material of the annular shielding body 51 may be particularly pressurized and deformed in its plane direction to spread the tip end of the projection part E11 and firmly fixed to the recess part E21 to stabilize the shape of the annular shielding body 51. Further, the annular shielding body 51 further includes an opening part E12 provided between the projection part E11 and the recess part E21, and the opening part E12 is so configured that a part of the resin material 53 contacts and fills both surfaces of the opening interfaces of the projection part E11 and the recess part E21 at the same time. Thus, since the continuity of the seam part 51*s* from one end side to the other end side of the annular shielding body 51 is intercepted, the airtightness of the seam part 51*s* is ensured.

In the present embodiment, the opening part E12 is provided at the tip end of the projection part E11. The opening width of the opening part E12 is formed to be greater than the gap between the first and second edge parts E1 and E2. Thus, the filling of the resin material 53 in the opening part E12 is allowed. Note that the opening part E12 may be provided at, for example, the bottom part of the recess part E21 rather than being provided at the projection part E11.

In addition, as shown in FIG. 7, the annular shielding body 51 further includes a connection end 54 opposed to the seating part 117 of the first connector 11 and a plurality of terminal parts 55 protruding in the axis direction from the connection end 54 and provided at intervals in the circumferential direction. The terminal parts 55 are electrically connected to the metal shielding structure 13 (FIG. 1) integrally bonded to the bottom surface of the seating part 117.

As shown in FIG. 3, the seating part 117 includes a penetration hole part 117*h* where the coaxial signal line 50 penetrates, and the shielding structure 13 is fixed to the bottom surface of the seating part 117. The shielding structure 13 includes a rectangular base part 131 made of a conductive material such as metal and fixed to the seating part 117 and four lateral wall parts 132 suspending in the axis direction from the peripheral edge part of the base part 131.

Figure 8:
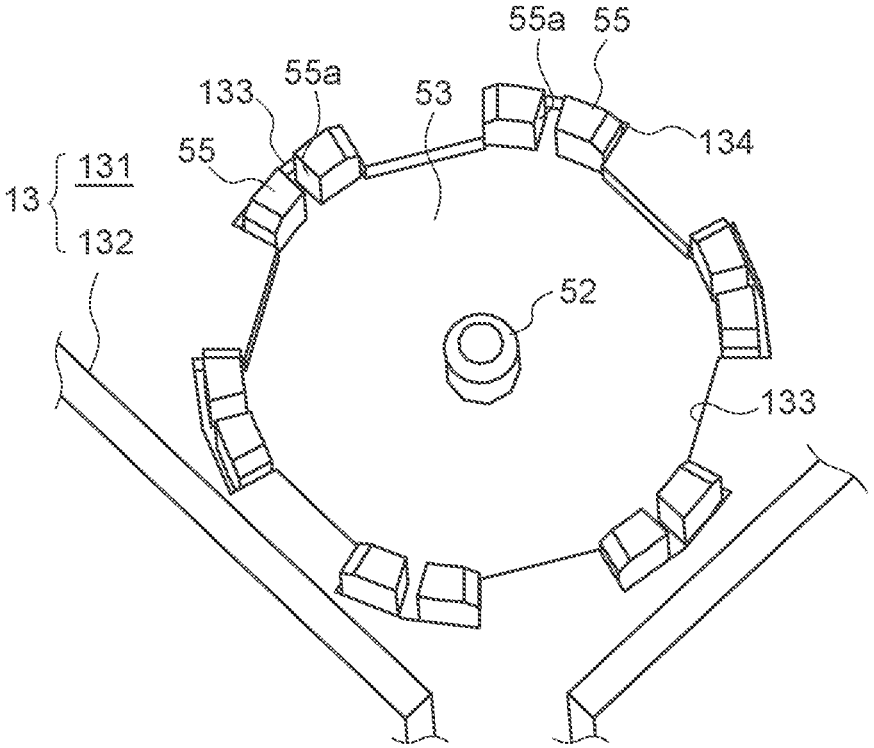
FIG. 8 is a perspective view of the substantial part for describing the fixation structure of a signal line in the connector device.

FIG. 8 is a perspective view of the rear surface of the base part 131 showing the connected mode between the terminal parts 55 and the shielding structure 13. The base part 131 includes an opening part 133 that causes the coaxial signal line 50 to be exposed and a plurality of engaging parts 134 formed at the edge of the opening part 133.

As shown in FIG. 8, the plurality of engaging parts 134 are constituted by a plurality of notch parts obtained by cutting off the peripheral edge part of the opening part 134 in the radial direction so as to be bonded to the plurality of terminal parts 55 in a finger joint form. Thus, the electrical connection between the annular shielding body 51 and the shielding structure 13 becomes symmetrical in the circumferential direction, and the occurrence of an impedance mismatch resulting from mechanical discontinuity can be minimized. Moreover, a design that minimizes electrically-continuous conductive opening parts is allowed, and a sufficient electromagnetic shielding effect is expected for electromagnetic waves (wavelength frequencies of a millimeter wave or less) used in normal high-speed transmission. Even if the evaluation of opening-part leakage depending on a specific frequency is not conducted, a sufficient shielding effect is obtained.

In the present embodiment, the tip ends of the respective terminal parts 55 are divided into two sections by dividing grooves 55*a*. The width of the dividing grooves 55*a* is expanded using a jig (not shown) for bonding, and the terminal parts 55 deformed in the circumferential direction are brought into intimate contact with engaging parts 134 (caulking processing). A ultrasonic bonding method may be applied to the engaging parts 134 and the terminal parts 55.

By applying ultrasonic bonding to the entire terminal parts 55 covered with the bonding part 53*a*, the above caulking processing is realized and the bonding part 53*a* is melted and bonded to the inner peripheral surface of the cylindrical body 110 by friction heat along, for example, a cylindrical bonding line (not shown) between the bonding part 53*a* covering the outer peripheral part of the annular shielding body 51 and the inner peripheral surface of the cylindrical body 110. Thus, a predetermined level or more of the bonding strength between the cylindrical body 110 and the coaxial signal line 50 is ensured.

The coaxial signal line 50 is configured as described above. The configuration is also applicable to the respective embodiments that will be described below.

Second Embodiment

Figure 9:
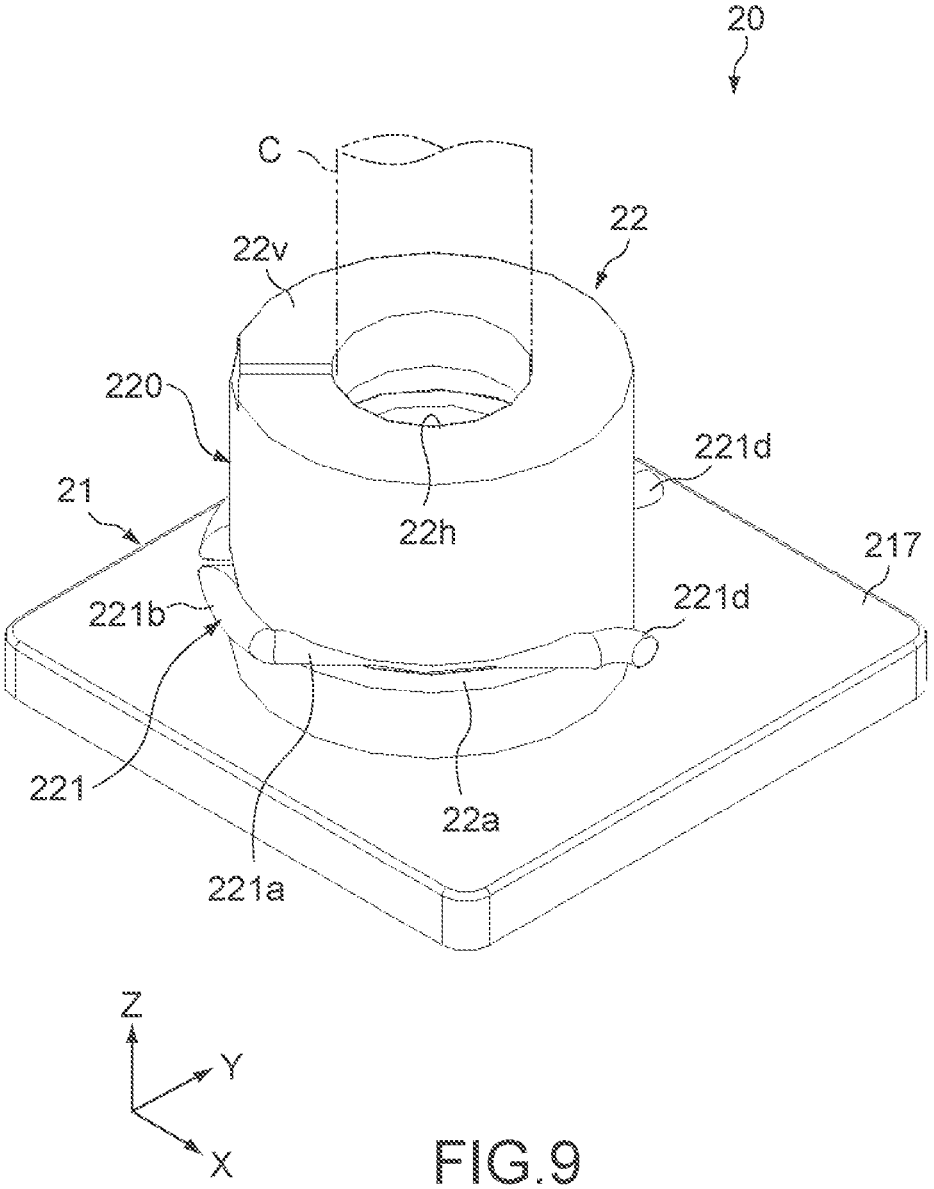
FIG. 9 is an entire perspective view of a connector device according to a second embodiment of the present technology.
Figure 10:
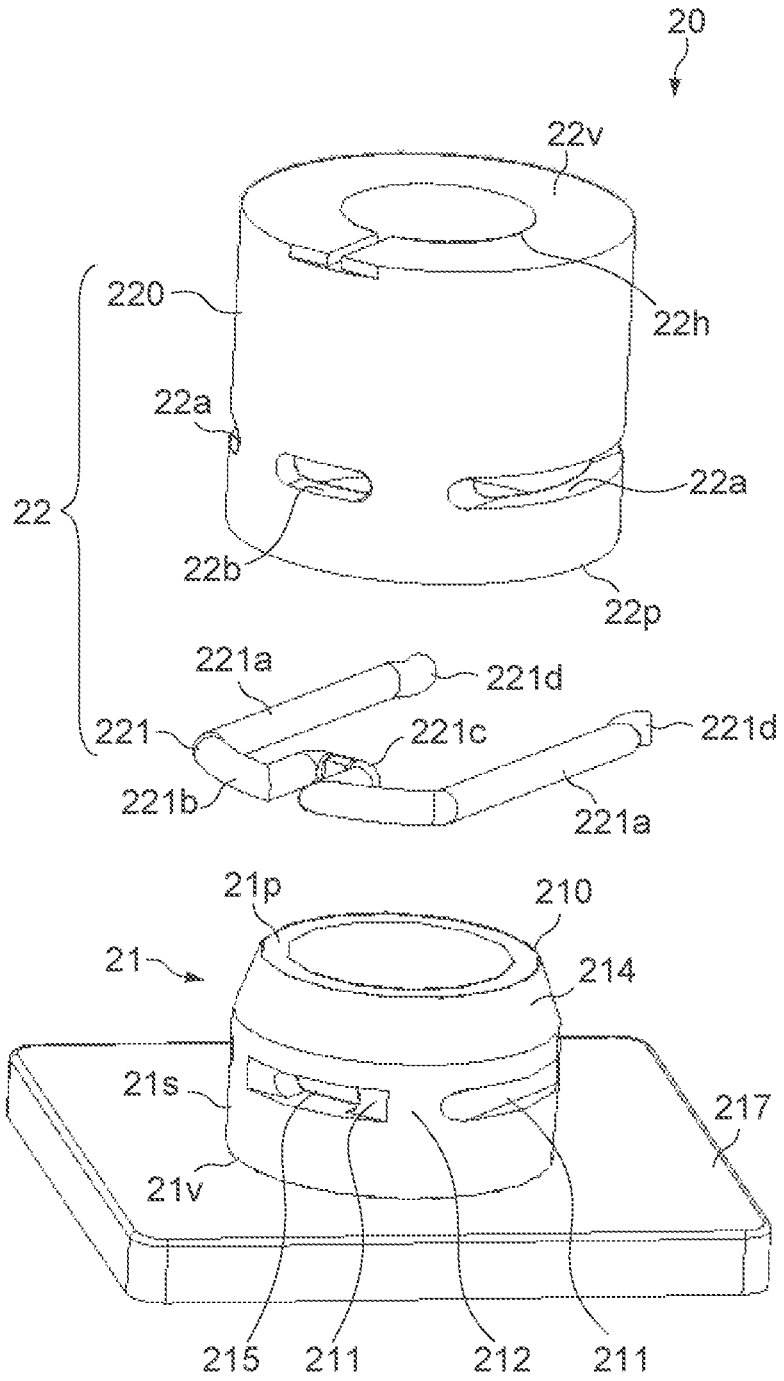
FIG. 10 is an exploded perspective view of the connector device.

Subsequently, a second embodiment of the present technology will be described. FIG. 9 is an entire perspective view of a connector device according to the present embodiment, and FIG. 10 is an exploded perspective view of the connector device.

[Connector Device]

A connector device 20 according to the present embodiment includes a first connector 21 and a second connector 22.

Each of the first connector 21 and the second connector 22 is configured as a coaxial connector capable of being mutually inserted and extracted in a Z-axis direction. In the present embodiment, the first connector 21 corresponds to a jack provided on the side of an apparatus, and the second connector 22 corresponds to a plug attached to the tip end of a coaxial cable 60.

Figure 11:
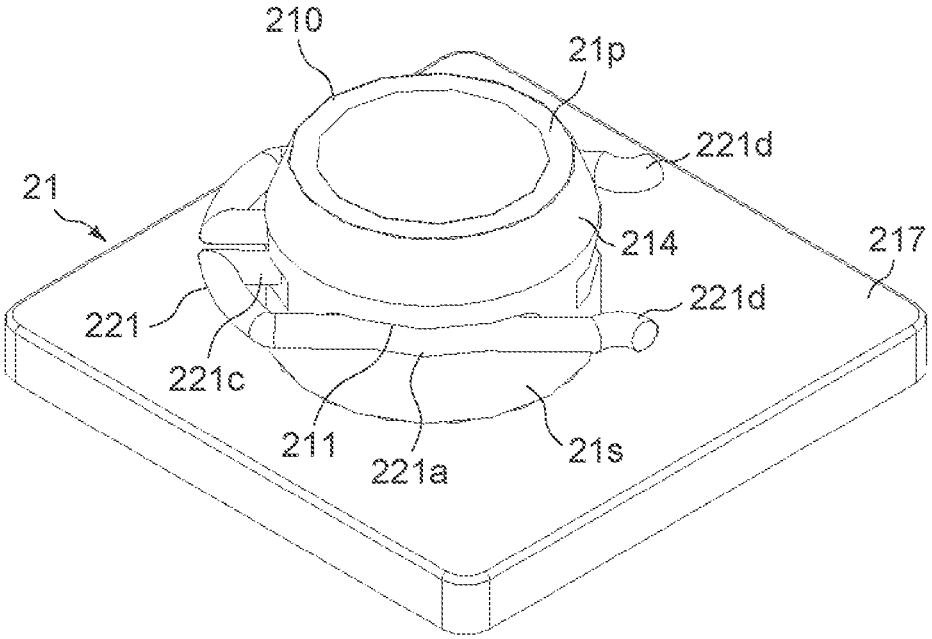
FIG. 11 is a partially-omitted perspective view for describing the locking structure of the connector device.
Figure 12:
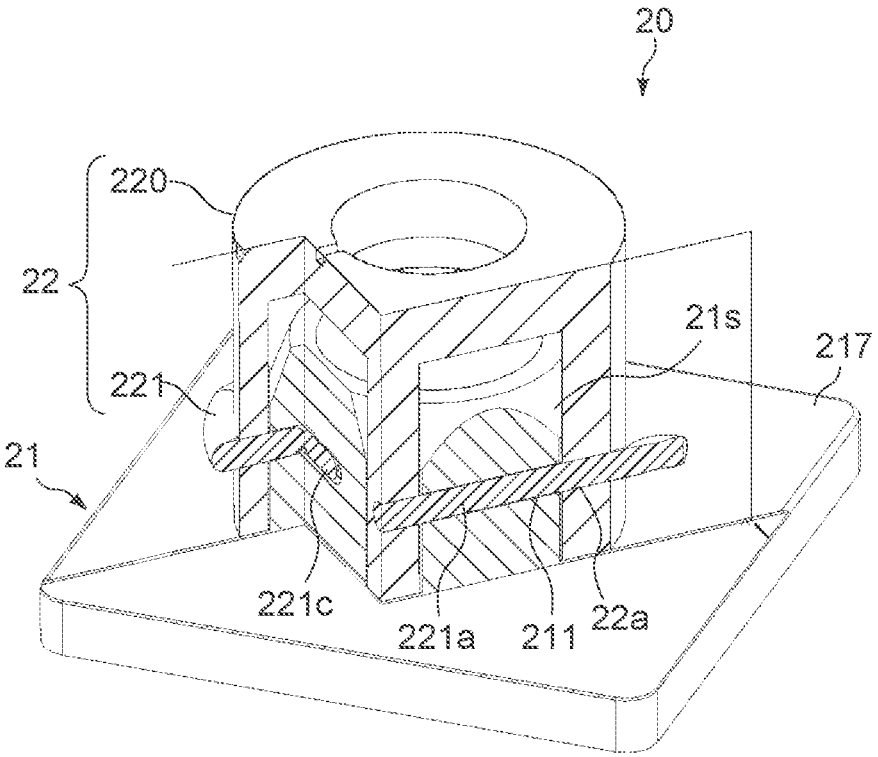
FIG. 12 is a lateral cross-sectional view of a substantial part for describing the locking structure of the connector device.

FIG. 11 is a perspective view showing the engaging state between an elastic member 221 and the first connector 21 in which a cylindrical body 220 is not shown. FIG. 12 is a cross-sectional view of the substantial part of the connector device 20 showing the bonding state between the first and second connectors 21 and 22.

(First Connector)

As shown in FIG. 10, the first connector 21 includes a cylindrical body 210 (first connector body), a plurality of locking groove parts 211, and a plurality of unlocking parts 212.

The cylindrical body 210 is typically constituted by an injection molded body made of a synthetic resin material and includes an outer peripheral surface 21*s* coaxially attached to a cylindrical body 220 of the second connector 22. The cylindrical body 210 is formed into a substantially cylindrical shape having an axis (central axis) parallel to the Z-axis direction. A tip end 21*p* of the cylindrical body 210 is opposed to the second connector 12, and a base end 21*v* of the cylindrical body 210 is fixed to a seating part 217.

The plurality of locking groove parts 211 are provided at intervals in a circumferential direction on the same circumference of the outer peripheral surface 21*s* of the cylindrical body 210. Each of the plurality of locking groove parts 211 has the same configuration and is formed into a shape capable of engaging elastic arm parts 221*a* of the elastic member 221 (see FIG. 11). In the present embodiment, the respective locking groove parts 211 are constituted by groove parts obtained by cutting off a part of the outer peripheral surface 21*s* in the circumferential direction (tangential line direction) orthogonal to a radial direction.

In the present embodiment, the plurality of locking groove parts 211 are provided at an interval of 90° in the circumferential direction of the outer peripheral surface 21*s*. The bottom part of the respective locking groove parts 211 is formed of a plane surface but may be formed of a curved surface (arc surface). The maximum depth of the respective locking groove parts 211 is not particularly limited but is formed in a size at which a predetermined level or more of an extracting force can be ensured with respect to the second connector 22.

In addition, a fitting hole 215 into which a fitting part 221*c* of the elastic member 221 is capable of being fitted is provided at the bottom part of the locking groove part 211 (see FIGS. 11 and 12). The fitting hole 215 is provided in at least one of the plurality of locking groove parts 211 but may be provided in all the locking groove parts 211.

The plurality of unlocking parts 212 are also provided at intervals in the circumferential direction on the same circumference of the outer peripheral surface 21*s* of the cylindrical body 210. Each of the plurality of unlocking parts 212 has the same configuration and is provided between the plurality of locking groove parts 211. Thus, the locking groove parts 211 and the unlocking parts 212 are arranged in the circumferential direction of the outer peripheral surface 21*s* with a positional displacement from each other.

The respective unlocking parts 212 are constituted by partially cylindrical surfaces having an outer diameter greater than that of the respective locking groove parts 211 and forming the outer diameter of the cylindrical body 210. The outer diameter of the unlocking parts 212 is set at a value equal to or less than the inner diameter of the cylindrical body 220 constituting the second connector 22. The unlocking parts 212 have the function of elastically deforming the arm parts 231 of the elastic member 23 attached to the cylindrical body 220 outward in the radial direction as will be described later.

The first connector 21 further includes a guiding part 214. The guiding part 214 is provided at the outer peripheral surface 21*s* on the side of a tip end 21*p* of the cylindrical body 210. The guiding part 214 is constituted by an appropriate tapered surface or a curved surface allowing a tip end 22*p* of the second connector 22 to be guided to the unlocking parts 212.

(Second Connector)

The second connector 22 includes a cylindrical body 220 (second connector body) and the elastic member 221.

The cylindrical body 220 is typically constituted by an injection molded body made of a synthetic resin material. The cylindrical body 220 is formed into a substantially cylindrical shape having an axis (central axis) parallel to the Z-axis direction. The tip end 22*p* of the cylindrical body 220 is opposed to the first connector 21, and a base end 22*v* of the cylindrical body 220 has a penetration hole 22*h* where a coaxial cable 60 penetrates. The second connector 22 is rotatably attached in a circumferential direction with respect to the tip end of the coaxial cable 60.

The elastic member 221 is made of a synthetic resin material or a metal material and includes the pair of elastic arm parts 221*a*, a connecting part 221*b*, the fitting part 221*c*, and stopper parts 221*d* as shown in FIG. 10.

The pair of elastic arm parts 221*a* is constituted by shaft parts extending parallel to each other in a direction orthogonal to the axis direction (Z-axis direction) of the cylindrical body 220 and accommodated in opening parts 22*a* formed on the peripheral surface of the cylindrical body 220 so as to move relatively with each other. The respective opening parts 22*a* are opposed to each other in the radial direction of the cylindrical body 220, and their opening shapes are long hole shapes extending along the elastic arm parts 221*a*. The respective elastic arm parts 221*a* pass through the inside of the cylindrical body 220 via the opening parts 22*a*. Parts of the respective elastic arm parts 221*a* passing through the inside of the cylindrical body 220 constitute a plurality of elastic parts provided on the inner peripheral surface of the cylindrical body 220.

The connecting part 221*b* connects one ends of the respective elastic arm parts 221*a* to each other. The fitting part 221*c* is formed by partially bending the substantially central part of the connecting part 221*b* so as to protrude toward the cylindrical body 220. The fitting part 221*c* is fitted into a fitting hole 22*b* of the cylindrical body 220 and so configured as to be capable of protruding toward the inside of the cylindrical body 220 via the fitting hole 22*b* by the sliding operation of the elastic arm parts 221*a* along the opening parts 22*a*.

The stopper parts 221*d* are provided at the other ends of the respective elastic arm parts 221*a* and contact the outer peripheral surface of the cylindrical body 220 to restrict a predetermined amount or more of the sliding movement of the elastic arm parts 221*a* inside the accommodation grooves 22*a*.

(Method of Attaching and Detaching Connectors)

The second connector 22 is connected to the first connector 21 with the elastic member 221 attached to the cylindrical body 220. In bonding the first and second connectors 21 and 22 together, the tip end 22*p* of the second connector 22 is fitted into the tip end 21*p* of the first connector 21.

Subsequently, the second connector 22 is pressed against the first connector 21 in the axis direction. Thus, the respective elastic arm parts 221*a* of the elastic member 221 are elastically deformed outward in the radial direction along the tapered surface of the guiding part 214 and typically run onto the unlocking parts 212.

Then, the second connector 22 is rotated in the circumferential direction (about the Z-axis) with respect to the first connector 21 to move the respective elastic arm parts 221*a* to the respective locking groove parts 211 of the first connector 21. Along with the rotating operation, the respective elastic parts 221*a* are elastically restored inward in the radial direction and engage the respective locking groove parts 211 (see FIGS. 11 and 12). After that, the elastic member 221 is operated to slide along the opening parts 22*a*, whereby the fitting part 221*c* is fitted into the fitting hole of the first connector 21 (see FIGS. 9, 11, and 12). Thus, the first and second connectors 21 and 22 are connected to each other.

On the other hand, the above operation is performed in an inverse order in separating the first and second connectors 21 and 22 from each other. That is, the elastic member 221 is operated to slide from a state shown in FIG. 9 to cancel the fitting state between the fitting part 221*c* and the fitting hole 215, and the second connector 22 is rotated by 45° in the circumferential direction with respect to the first connector 21. Thus, the respective elastic arm parts 221*a* of the elastic member 221 are moved from the locking groove parts 211 to the unlocking parts 212. Along with the rotating operation, the respective elastic arm parts 221*a* are elastically deformed outward in the radial direction. After that, the second connector 22 is extracted in the axis direction from the first connector 21, whereby both the connectors 21 and 22 are separated from each other.

In the present embodiment as well, it is possible to realize the locking and unlocking of the first and second connectors 21 and 22 by the relative rotating operation between the first and second connectors 21 and 22 like the first embodiment. Thus, according to the present embodiment, the same functions and effects as those of the first embodiment can be obtained.

Particularly, since the guiding part 214 of the first connector 21 is provided at an entire outer peripheral surface on the side of the tip end 21*p* of the cylindrical body 210 according to the present embodiment, the positioning of the second connector 22 with respect to the first connector 21 in the circumferential direction becomes unnecessary. Thus, the connection between the connectors is facilitated. In addition, since the guiding part 214 is formed over the circumference of the cylindrical body 210, the respective elastic arm parts 221*a* of the elastic member 221 can be guided to the locking groove parts 211 without passing through the unlocking parts 212 depending on the attitude of the second connector 22.

Third Embodiment

Figure 13:
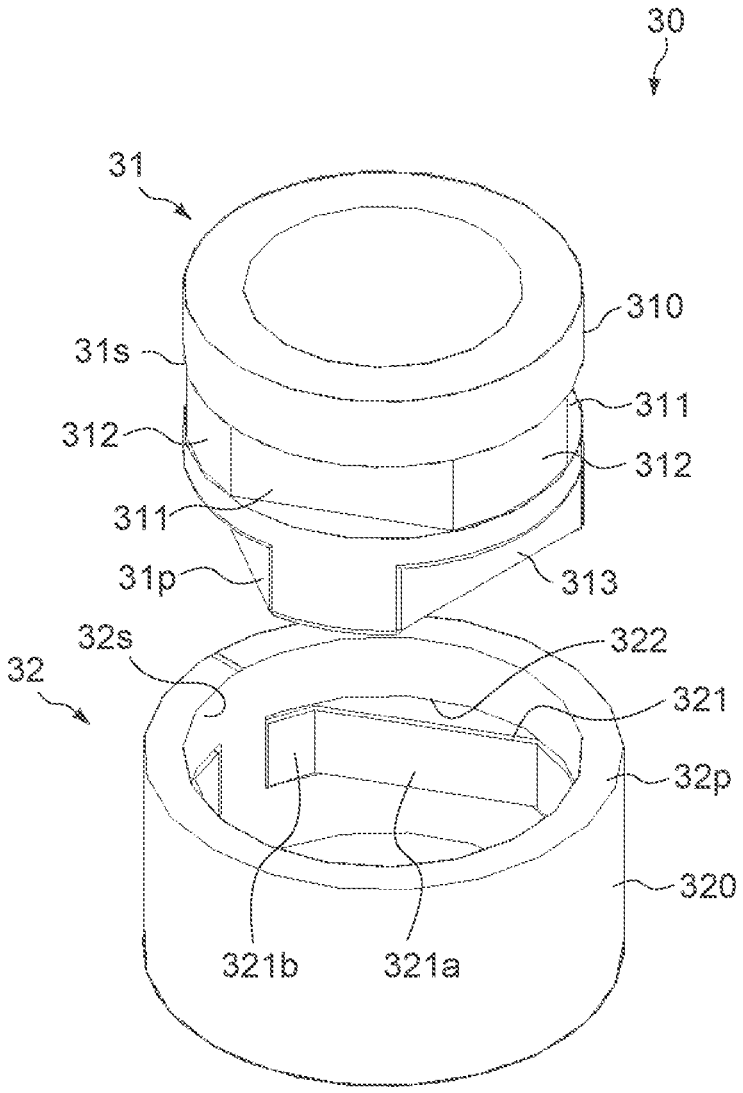
FIG. 13 is an exploded perspective view of a connector device according to a third embodiment of the present technology.

Subsequently, a third embodiment of the present technology will be described. FIG. 13 is an exploded perspective view of a connector device according to the present embodiment.

A connector device 30 according to the present embodiment includes a first connector 31 and a second connector 32.

Each of the first connector 31 and the second connector 32 is configured as a coaxial connector capable of being mutually inserted and extracted in a Z-axis direction. In the present embodiment, the first connector 31 corresponds to a jack provided on the side of an apparatus, and the second connector 32 corresponds to a plug attached to the tip end of a coaxial cable 60.

Figure 14:
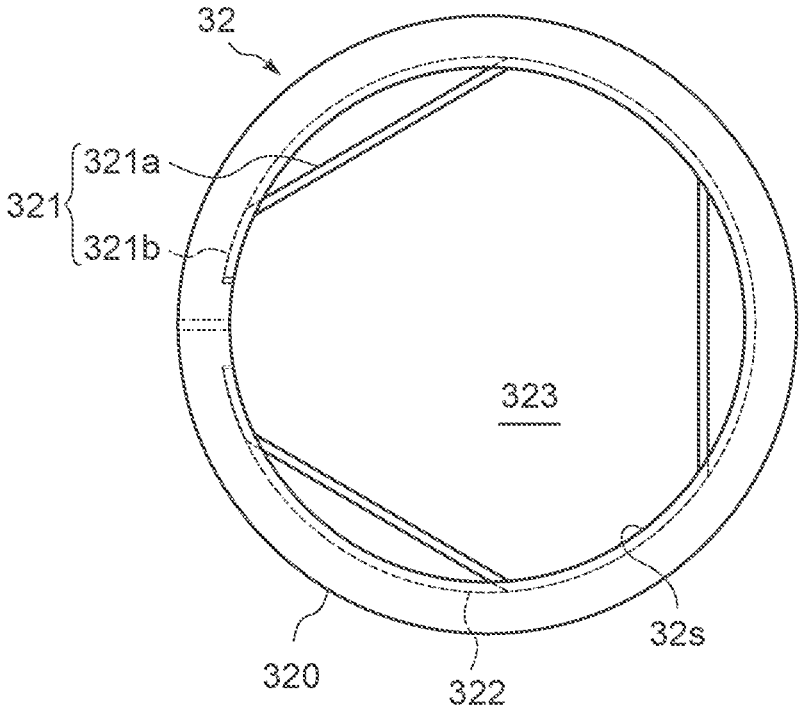
FIG. 14 is a plan view of a first connector in the connector device.
Figure 15:
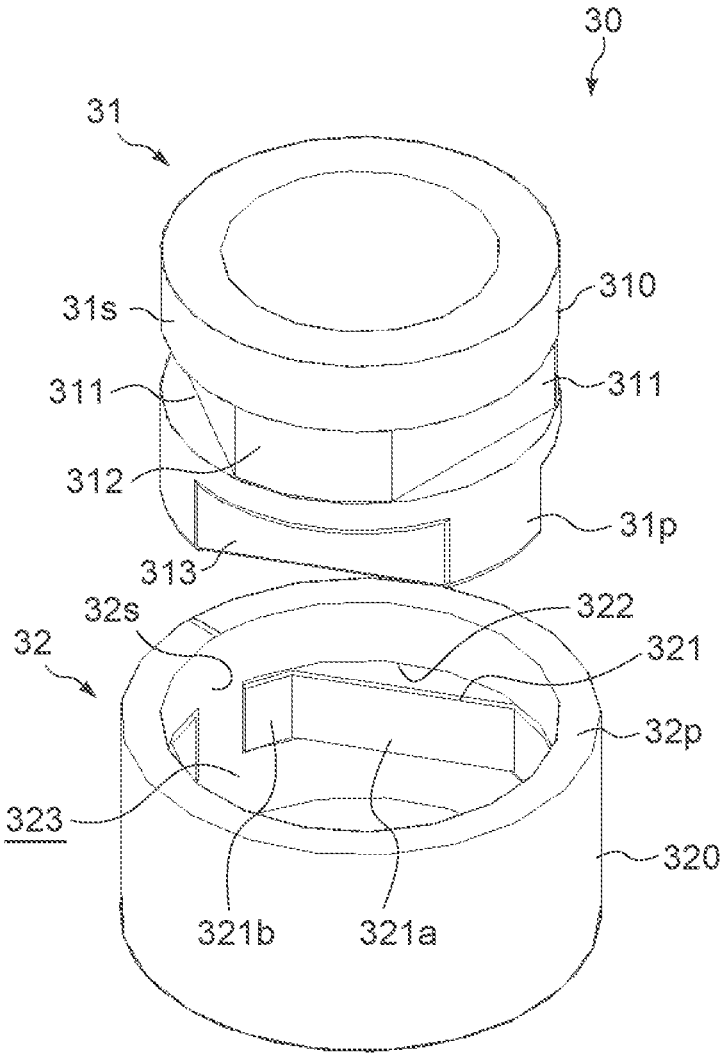
FIG. 15 is a perspective view for describing a procedure for attaching and detaching the connector device.
Figure 16:
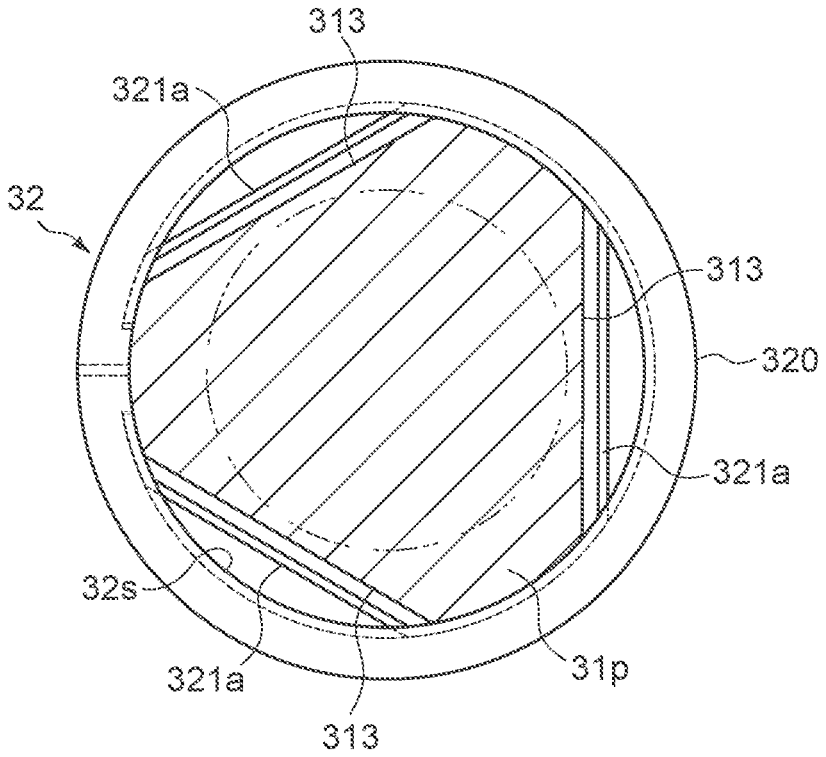
FIG. 16 is a cross-sectional plan view for describing the procedure for attaching and detaching the connector device.
Figure 17:
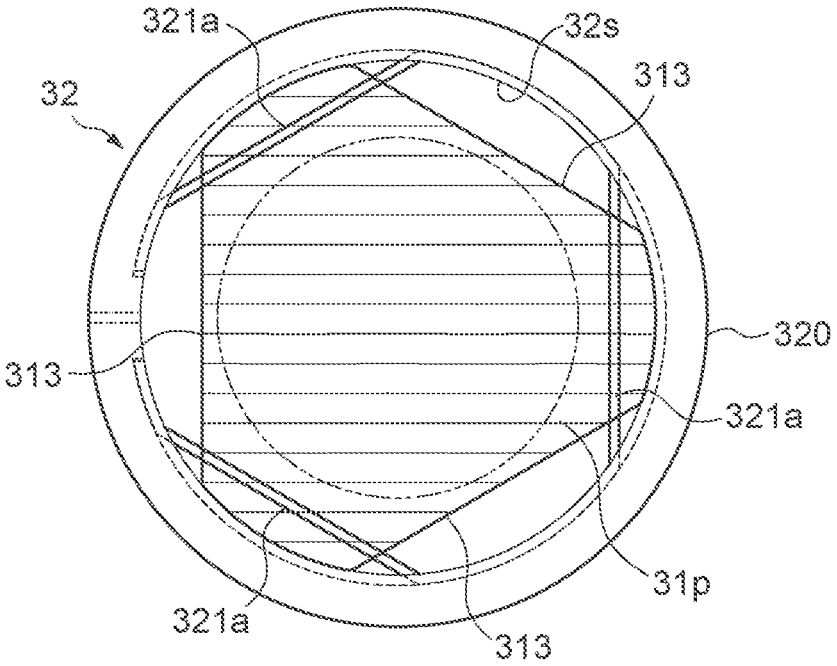
FIG. 17 is a cross-sectional plan view for describing the procedure for attaching and detaching the connector device.
Figure 18:
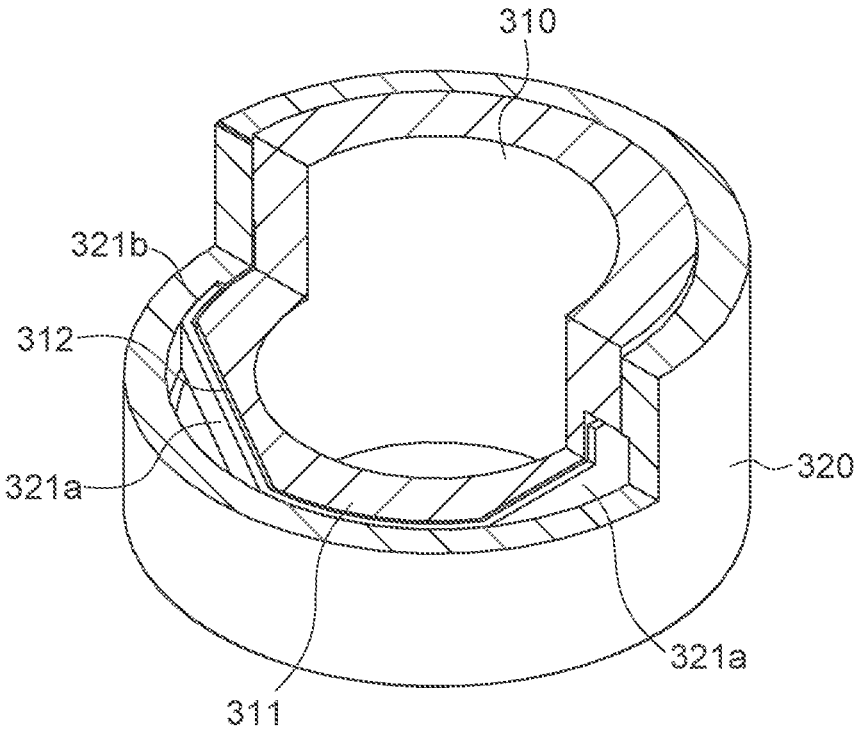
FIG. 18 is a cross-sectional perspective view for describing the procedure for attaching and detaching the connector device.
Figure 19:
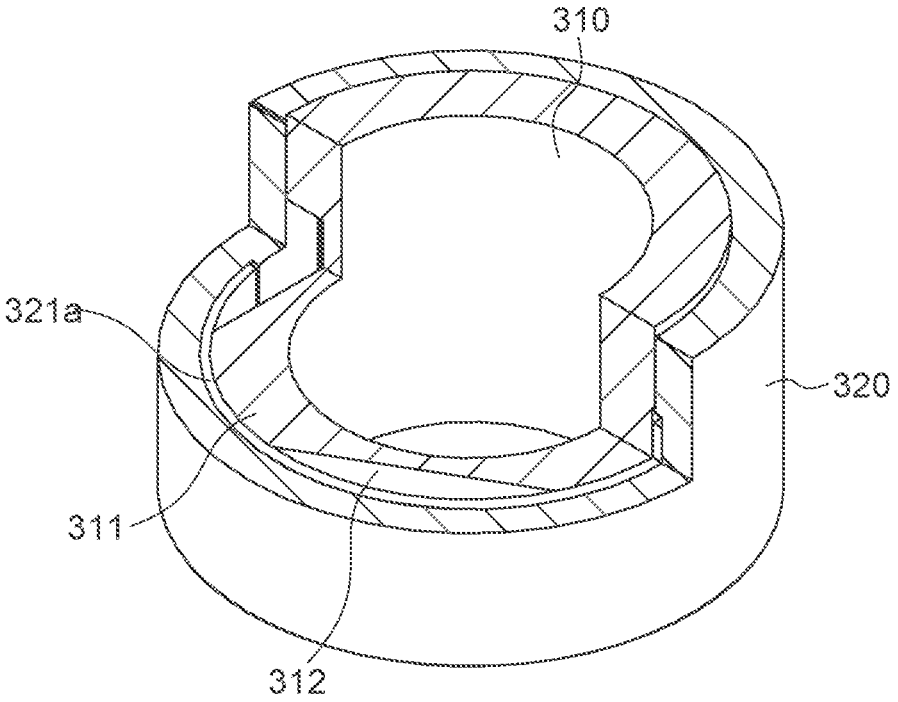
FIG. 19 is a cross-sectional perspective view for describing the procedure for attaching and detaching the connector device.

FIG. 14 is a plan view of the attached state of the first connector 31, FIG. 15 is a perspective view for describing a procedure for attaching and detaching the connector device 30, FIGS. 16 and 17 are cross-sectional plan views of the connector device 30, and FIGS. 18 and 19 are cross-sectional perspective views of the connector device 30.

(First Connector)

As shown in FIG. 13, the first connector 31 includes a cylindrical body 310 (first connector body), a plurality of locking groove parts 311, and a plurality of unlocking parts 312.

The cylindrical body 310 is typically constituted by an injection molded body made of a synthetic resin material and includes an outer peripheral surface 31*s* coaxially attached to a cylindrical body 320 of the second connector 32. The cylindrical body 310 is formed into a substantially cylindrical shape having an axis (central axis) parallel to the Z-axis direction.

The plurality of locking groove parts 311 are provided at intervals in a circumferential direction on the same circumference of the outer peripheral surface 31*s* of the cylindrical body 310. Each of the plurality of locking groove parts 311 has the same configuration and is constituted by a groove part having a rectangular opening shape obtained by cutting off a part of the outer peripheral surface 31*s* in the circumferential direction (tangential line direction) orthogonal to a radial direction. The plurality of locking groove parts 311 are provided on the outer peripheral surface 11*s* at the substantially central part of the cylindrical body 310.

In the present embodiment, the respective locking groove parts 311 are provided at an interval of 120° in the circumferential direction of the outer peripheral surface 31*s*. The respective locking groove parts 311 have a rectangular opening shape long in the circumferential direction. The bottom part of the respective locking groove parts 311 is formed of a plane surface but may be formed of a curved surface (arc surface). The maximum depth of the respective locking groove parts 311 is not particularly limited but is formed in a size at which a predetermined level or more of an extracting force can be ensured with respect to the second connector 32.

The plurality of unlocking parts 312 are also provided at intervals in the circumferential direction on the same circumference of the outer peripheral surface 31*s* of the cylindrical body 310. Each of the plurality of unlocking parts 312 has the same configuration and is provided between the plurality of locking groove parts 311 at an interval of 120° in the circumferential direction of the outer peripheral surface 31*s*. Thus, the locking groove parts 311 and the unlocking parts 312 are arranged in the circumferential direction of the outer peripheral surface 31*s* with a positional displacement from each other (the locking groove parts 311 and the unlocking parts 312 are alternately arranged in the circumferential direction).

The respective unlocking parts 312 are constituted by partial cylindrical surfaces having an outer diameter greater than that of the respective locking groove parts 311. The outer diameter of the unlocking parts 312 is set at a size equal to or less than the inner diameter of a cylindrical body constituting the second connector 32 as will be described later, and the unlocking parts 312 have the function of elastically deforming an elastic member 321 attached to the second connector 32 outward in the radial direction.

The first connector 31 further includes a plurality of positioning parts 313. The plurality of positioning parts 313 are provided at intervals in the circumferential direction on the same circumference of the outer peripheral surface 31*s* of the cylindrical body 310. The plurality of positioning parts 313 are provided on the outer peripheral surface on the side of a tip end 31*p* of the cylindrical body 310.

Each of the plurality of positioning parts 313 has the same configuration and is constituted by a notch part obtained by cutting off a part of the outer peripheral surface of the tip end 31*p* in the circumferential direction (tangential line direction) orthogonal to the radial direction. The respective positioning parts 313 are opened on their sides close to the tip end 31*p* of the cylindrical body 310 and configured to be capable of being fitted into a tip end 32*p* of the second connector 32. That is, the respective positioning parts 313 are used to position the first connector 31 in the circumferential direction with respect to the second connector 32 when the first connector 31 and the second connector 32 are bonded together.

The respective positioning parts 313 are provided on the outer peripheral surface of the tip end 31*p* at an interval of 120° to be adjacent to the plurality of unlocking parts 312 in the axis direction (Z-axis direction). The plane shape of the tip end 31*p* is formed into a substantially triangular shape of which the respective side parts are adjacent to the unlocking parts 313 and the respective apexes are adjacent to the locking groove parts 311 in the axis direction.

(Second Connector)

The second connector 32 includes the cylindrical body 320 (second connector body) and an elastic member 321.

The cylindrical body 320 is typically constituted by an injection molded body made of a synthetic resin material. The cylindrical body 320 is formed into a substantially cylindrical shape having an axis (central axis) parallel to the Z-axis direction.

The elastic member 321 is typically constituted by a metal plate spring. As shown in FIG. 14, the elastic member 321 is folded into a substantially hexagonal shape and arranged in an annular groove part 322 having its outermost peripheral surface buried in an inner peripheral surface 32*s* of the cylindrical body 320. The first connector 31 is restricted in the axis direction of the cylindrical body by the elastic member 321. The elastic member 321 includes three elastic arm parts 321*a* passing through the cylindrical body 320 on an inner side in the radial direction than the inner peripheral surface 32 and two ends 321*b* opposed to each other in the circumferential direction of the cylindrical body 320. The respective elastic arm parts 321*a* constitute a plurality of elastic parts provided on the inner peripheral surface 32*s* of the cylindrical body 320. The groove part 322 is formed into an arc shape along the inner peripheral surface 32*s* of the cylindrical body 320. By the contacting operation between the ends of the groove part 322 in the circumferential direction and the ends 321*b* of the elastic member 321, the rotation of the elastic member 321 is restricted in the circumferential direction by the groove part 322.

The groove part 322 is formed at a substantially central part in the height direction on the inner peripheral surface 32*s* of the cylindrical body 320. The respective elastic arm parts 321*a* of the elastic member 321 are arranged along the circumferential direction of the inner peripheral surface 32*s* at an interval of approximately 120° at the height position. The elastic member 321 defines a space part 323 inside the cylindrical body 320, the space part 323 having a size allowing the tip end 31*p* and the respective unlocking parts 312 of the cylindrical body 310 to be accommodated inside the cylindrical body 320. The width of the plate spring constituting the elastic member 321 (the height of the arm parts 321*a*) is formed to be equal to or less than the formed width of the locking groove parts 311 of the first connector 31.

(Method of Attaching and Detaching Connectors)

In bonding the first and second connectors 31 and 32 together, the first and second connectors 31 and 32 are first opposed to each other in the axis direction in their attitudes in which the positioning parts 313 of the first connector 31 and the space part 323 defined by the respective elastic arm parts 321*a* inside the second connector 32 are capable of being fitted to each other as shown in FIG. 15. When the first connector 31 is rotated by 60° from a positional relationship shown in FIG. 15, a positional relationship shown in FIG. 13 is obtained.

Subsequently, the respective positioning parts 313 of the first connector 31 are fitted into the space part 323. After that, the first connector 31 is rotated by 60° in the circumferential direction (about the Z-axis), while being pressed against the second connector 32 in the axis direction. Thus, the respective elastic arm parts 321*a* are elastically deformed and spread outward in the radial direction by the peripheral surface part of the tip end 31*p*, whereby it becomes possible to press the first connector 31 in the axis direction beyond the restraint of the positioning parts 313 in the axis direction. When the insertion of the first connector 31 is completed up to the locking groove parts 311, the respective elastic arm parts 321 are elastically restored inward in the radial direction at their opposed positions and engage the locking groove parts 311 (FIGS. 16 to 18). Thus, the first and second connectors are connected to each other. Note that the first connector 31 may be moved in the axis direction after being rotated by 60° in the circumferential direction with respect to the second connector 31.

On the other hand, the above operation is performed in an inverse order in separating the first and second connectors 31 and 32 from each other. That is, the first connector 31 is rotated by 60° in the circumferential direction with respect to the second connector 32 from a state shown in FIGS. 17 and 18 to elastically deform the respective elastic arm parts 321*a* outward in the radial direction. After that, the first connector 31 is extracted in the axis direction from the second connector 32, whereby both the connectors 31 and 32 are separated from each other (FIG. 13).

In the present embodiment as well, it is possible to realize the locking and unlocking of the first and second connectors 31 and 32 by the relative rotating operation between the first and second connectors 31 and 32 like the first embodiment. Thus, according to the present embodiment, the same functions and effects as those of the first embodiment can be obtained. The mechanism of spreading out the elastic arm parts 321*a* when the first connector 31 is inserted into the second connector 32 is not limited to the taper of the peripheral rotation of the positioning parts 313 as in the present embodiment. For example, the tip end 31*p* of the first connector 31 may have a tapered structure.

Fourth Embodiment

Figure 20:
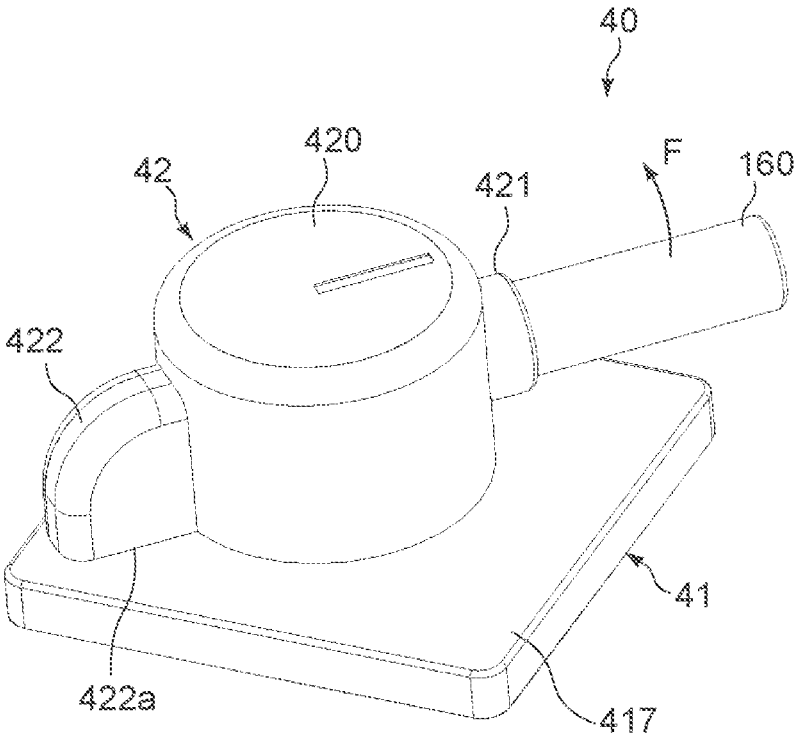
FIG. 20 is a perspective view of a connector device according to a fourth embodiment of the present technology.

Subsequently, a fourth embodiment of the present technology will be described. FIG. 20 is an exploded perspective view of a connector device according to the present embodiment.

A connector device 40 according to the present embodiment includes a first connector 41 and a second connector 42. In the present embodiment, the first connector 41 corresponds to a jack provided on the side of an apparatus, and the second connector 42 corresponds to a plug attached to the tip end of a cable 160.

The second connector 42 includes a cylindrical body 420 fitted into the cylindrical body of the first connector 41. In the figure, the configuration of the cylindrical body 420 is simplified to be shown but includes the same locking mechanism as those of the above embodiments.

In the connector device 40 according to the present embodiment, the cylindrical body 420 (second connector body) includes a cable insertion part 421 and a protrusion part 422. The cable insertion part 421 protrudes outward in a radial direction from the cylindrical body 420, and the cable 160 is inserted into the cable insertion part 421. The protrusion part 422 protrudes from the cylindrical body 420 in a direction opposite to the protruding direction of the cable insertion part 421 and includes an opposed surface 422*a* opposed to a seating part 417 of the first connector 41.

In the connector device 40 according to the present embodiment, even if an external force (indicated by arrow F in the figure) that separates the first and second connectors 41 and 42 from each other acts on the cable 160, the application of the external force F to the locking mechanism inside the connectors can be blocked by the contacting operation between the opposed surface 422*a* of the protrusion part 422 and the seating part 417. If the protrusion part 422 does not exist, a force acts on the contact point of the cylindrical part of the connector 42 and a local locking place and a great force is locally applied to a locking part by the lever rule, which causes resin deformation and destructive breakage. On the other hand, the distance of a force applied to the locking part when the external force F is applied to a harness is extended to its power point and a point of application and the occurrence of rotation due to a play can be reduced by the provision of the protrusion part 422. Therefore, the force is evenly applied to the locking part, and high reliability is obtained. Thus, since a local stress applied to the locking mechanism is received by the entire second connector 42, the connection reliability of the locking mechanism is ensured. Such functions and effects become more remarkable as the connector device is smaller in size.

The embodiments of the present technology are described above, but the present technology is not limited to the above embodiments. Various modifications can be, of course, added to the embodiments.

For example, the above embodiments exemplify the connectors for connecting coaxial cables to electronic apparatuses. The present technology is not limited to the connectors but is also applicable to connectors for connecting two-core or four-core LVDS signal lines. In addition, although the above embodiments do not describe the waterproofing function of a fitting part when a first connector and a second connector are fitted together, a waterproofing member such as an O-ring and a waterproofing gasket crushed in an axis direction when the connectors are fitted together may be attached to the cylindrical column lateral surface of a cylindrical body.

In addition, the above embodiments describe the first connectors as jacks and the second connectors as plugs. However, the first connectors may be constituted as plugs, and the second connectors may be constituted as jacks.

In addition, the above embodiments include the three or four elastic parts and the locking groove parts constituting the locking mechanisms of the connector devices. However, the numbers of the elastic parts and the locking groove parts are, of course, not limited to such numbers, but at least two or more elastic parts and locking groove parts may only be provided. In addition, the number of the elastic parts may not correspond to the number of the locking groove parts. For example, the number of the locking groove parts may be greater than the number of the elastic parts.

Figure 21:
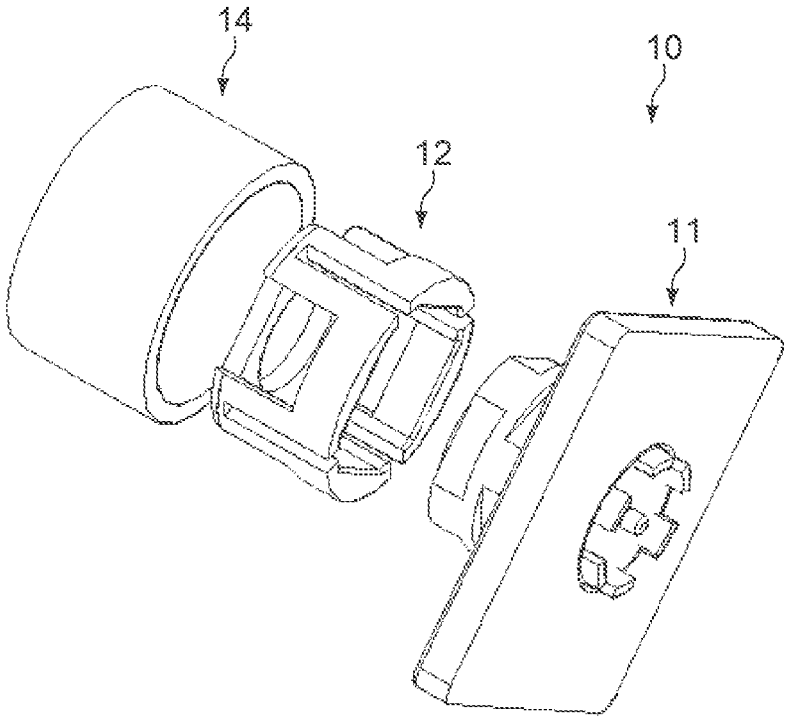
FIG. 21 is a perspective view showing a modified example of the connector device according to the first embodiment.

In addition, in the first embodiment, the connector device 10 may further include a tubular member 14 that coats the periphery of the second connector 12 as shown in FIG. 21. The tubular member 14 includes an inner peripheral surface fitted into the outer peripheral surface of the second connector 12. Thus, the locking state of the second connector 12 with respect to the first connector 11 can be maintained, and the careless unlocking operation of the first and second connectors 11 and 12 can be prevented.

In addition, in the third embodiment, the tip end 31*p* of the first connector 31 may be formed into a shape tapered toward the second connector 32. In this case, the plurality of elastic arm parts 321*a* can be elastically deformed outward in the radial direction when the connectors are fitted together regardless of the rotating attitude of the tip end 31*p* with respect to the second connector 32. Thus, the connecting workability of the first and second connectors 31 and 32 can be further improved.

Figure 22:
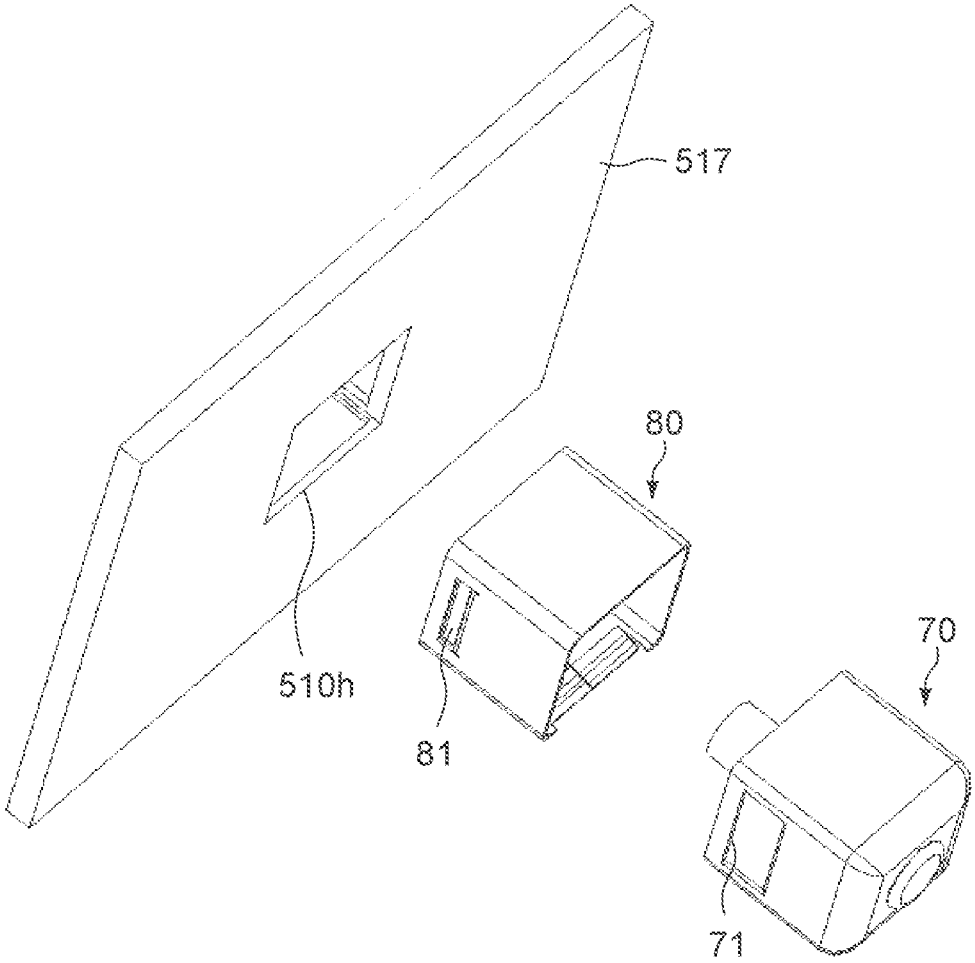
FIG. 22 is perspective view for describing the holding structure of an electronic apparatus accommodated in a connector device.

FIG. 22 shows a camera 70 that serves as an electronic apparatus accommodated in a seating part 517 of a connector and a holding member 80 that fixes the camera 70 to the seating part 517. The holding member 80 is accommodated in an opening part 510*h* of the seating part 517. The outer shapes of the holding member 80 and the opening part 510*h* are set according to the outer shape of the camera 70. In an illustrated example, the camera 70 has a cubic shape, and its two opposed lateral surfaces are provided with engaging grooves 71 capable of engaging claw parts 81 provided on the two lateral surfaces of the holding member 80. Thus, it becomes possible to stably hold the camera 70 without applying special processing to the seating part 517 and prevent the complexity of the structure of a connector.

Note that the present technology can also employ the following configurations.

(1) A connector device including:

a first connector having a first connector body having a first peripheral surface, a plurality of locking groove parts provided on the first peripheral surface, and a plurality of unlocking parts provided on the first peripheral surface, the plurality of locking groove parts and the plurality of unlocking parts being arranged in a circumferential direction of the first peripheral surface with a positional displacement from each other; and a second connector having a second connector body having a second peripheral surface and fitted into the first connector body and a plurality of elastic parts provided on the second peripheral surface and held by the plurality of locking groove parts, respectively, the plurality of elastic parts being configured to be elastically deformable in a radial direction of the second connector body when rotating in a circumferential direction of the second connector body between the plurality of locking groove parts and the plurality of unlocking parts.

(2) The connector device according to (1), in which the first connector body is constituted by a cylindrical body having the first peripheral surface as an outer peripheral surface and coaxially attached to the second connector body.

(3) The connector device according to (2), in which the cylindrical body has a first end including a guiding surface provided adjacent to the plurality of unlocking parts in an axis direction, and the guiding surface has a tapered shape with which the plurality of elastic parts are elastically deformed when the first connector body is attached to the second connector body in the axis direction.

(4) The connector device according to (3), in which the guiding surface has a plurality of positioning parts that position the plurality of elastic pieces in the circumferential direction.

(5) The connector device according to any one of (1) to (4), in which the plurality of locking groove parts allow movement of the plurality of elastic parts in the circumferential direction and restrict movement of the plurality of elastic parts in the axis direction.

(6) The connector device according to any one of (1) to (5), in which the plurality of elastic parts have respective engaging claws that engage the plurality of locking groove parts.

(7) The connector device according to any one of (1) to (5), in which the second connector has an elastic member attached to the second peripheral surface, and the plurality of elastic parts are constituted by a part of the elastic member.

(8) The connector device according to (3) or (4), in which the cylindrical body further has a second end on a side thereof opposite to the first end, and the first connector further has a flat-shaped seating part that supports the second end.

(9) The connector device according to (8), in which the second connector further has a cable insertion part that protrudes outward in the radial direction from the second connector body, and a protrusion part that protrudes from the second connector body in a direction opposite to a protruding direction of the cable insertion part and has an opposed surface opposed to the seating part.

(10) The connector device according to (8) or (9), further including:

a coaxial signal line provided inside the cylindrical body, in which the coaxial signal line has a metal annular shielding body having a first edge part and a second edge part opposed to the first edge part in the circumferential direction and having a plurality of penetration holes formed on a peripheral surface thereof, a shaft-shaped terminal arranged at an axis part of the annular shielding body, and a resin member that is filled in the cylindrical body and integrally fixes the annular shielding body and the shaft-shaped terminal together.

(11) The connector device according to (10), in which the first edge part has a projection part that protrudes toward the second edge part, the second edge part has a recess part that accommodates the projection part, and the annular shielding body further has an opening part that is provided between the projection part and the recess part and filled with a part of the resin member.

(12) The connector device according to (10) or (11), in which the annular shielding body further has a connection end that is opposed to the seating part and a plurality of terminal parts that protrude in the axis direction from the connection end and are provided at intervals in the circumferential direction, and the first connector further has a shielding structure that is fixed to the seating part and has a plurality of engaging parts that engage the plurality of terminal parts.

(13) A coaxial connector configured to be capable of being inserted into and extracted from a counter-side connector having a plurality of elastic parts provided along a circumferential direction of an inner peripheral surface thereof, the coaxial connector including:

a connector body having a cylindrical body having an outer peripheral surface capable of being fitted into the inner peripheral surface, a plurality of locking groove parts that are provided on the outer peripheral surface and capable of holding the plurality of elastic parts, and a plurality of unlocking parts provided on the outer peripheral surface, the plurality of locking groove parts and the plurality of unlocking parts being arranged in a circumferential direction of the outer peripheral surface with a positional displacement from each other, and being configured to allow the plurality of elastic parts to be elastically deformed in a radial direction of the cylindrical body when rotating in the circumferential direction of the cylindrical body between the plurality of locking groove parts and the plurality of unlocking parts.

(14) A coaxial connector configured to be capable of being inserted into and extracted from a counter-side connecter in which a plurality of locking groove parts and a plurality of unlocking parts are arranged in a circumferential direction of an outer peripheral surface with a positional displacement from each other, the coaxial connector including:

a connector body having a cylindrical body having an inner peripheral surface capable of being fitted into the outer peripheral surface, and a plurality of elastic parts that are provided on the inner peripheral surface and held by the plurality of locking groove parts, respectively, the plurality of elastic parts being configured to be elastically deformable in a radial direction of the cylindrical body when rotating in a circumferential direction of the cylindrical body between the plurality of locking groove parts and the plurality of unlocking parts.

REFERENCE SIGNS LIST

10, 20, 30, 40 connector device
11, 21, 31, 41 first connector
12, 22, 32, 42 second connector
50 coaxial signal line
60 coaxial cable
110, 210, 310 cylindrical body (first connector body)
117, 217, 417 seating part
120, 220, 320 cylindrical body (second connector body)
121 elastic part
111, 211, 311 locking groove part
112, 212, 312 unlocking part
113, 313 positioning part
114 guiding part
221, 321 elastic member
221*a*, 321*a* arm part
421 cable insertion part
422 protrusion part

The invention claimed is:

1. A connector device, comprising:

a first connector having a first connector body, wherein the first connector body has a first peripheral surface, a plurality of locking groove parts is on the first peripheral surface, a plurality of unlocking parts is on the first peripheral surface, the plurality of locking groove parts and the plurality of unlocking parts are in a first circumferential direction of the first peripheral surface, and the plurality of locking groove parts is in a positional displacement from the plurality of unlocking parts; and a second connector having a second connector body, wherein the second connector body has a second peripheral surface, the second connector body is fitted into the first connector body, a plurality of elastic parts is on the second peripheral surface, the second peripheral surface is different from the first peripheral surface, the plurality of elastic parts is held by the plurality of locking groove parts, respectively, and the plurality of elastic parts is configured to deform elastically in a radial direction of the second connector body based on rotation in a second circumferential direction of the second connector body between the plurality of locking groove parts and the plurality of unlocking parts.

2. The connector device according to claim 1, wherein the first connector body is constituted by a cylindrical body having the first peripheral surface as an outer peripheral surface, and the first connector body is coaxially attached to the second connector body.

3. The connector device according to claim 2, wherein the cylindrical body has a first end including a guiding surface adjacent to the plurality of unlocking parts in an axis direction, and the guiding surface has a tapered shape with which the plurality of elastic parts is elastically deformed when the first connector body is attached to the second connector body in the axis direction.

4. The connector device according to claim 3, wherein the guiding surface has a plurality of positioning parts, wherein the plurality of positioning parts positions the plurality of elastic parts in the first circumferential direction.

5. The connector device according to claim 1, wherein the plurality of locking groove parts enables movement of the plurality of elastic parts in the first circumferential direction and restrict movement of the plurality of elastic parts in an axis direction.

6. The connector device according to claim 1, wherein each elastic part of the plurality of elastic parts has engaging claws that engage a corresponding locking groove part of the plurality of locking groove parts.

7. The connector device according to claim 1, wherein the second connector has an elastic member attached to the second peripheral surface, and the plurality of elastic parts is constituted by a part of the elastic member.

8. The connector device according to claim 3, wherein the cylindrical body further has a second end on a side opposite to the first end, and the first connector further has a flat-shaped seating part that supports the second end.

9. The connector device according to claim 8, wherein the second connector further includes:

a cable insertion part that protrudes outward in the radial direction from the second connector body; and a protrusion part that protrudes from the second connector body in a direction opposite to a protruding direction of the cable insertion part, wherein the protrusion part has a surface opposite to the seating part.

10. The connector device according to claim 8, further comprising a coaxial signal line inside the cylindrical body, wherein the coaxial signal line includes:

a metal annular shielding body having a first edge part, and a second edge part opposite to the first edge part in the first circumferential direction, wherein the metal annular shielding body has a plurality of penetration holes on a third peripheral surface;

a shaft-shaped terminal at an axis part of the metal annular shielding body; and a resin member filled in the cylindrical body and integrally fixes the metal annular shielding body and the shaft-shaped terminal together.

11. The connector device according to claim 10, wherein the first edge part has a projection part that protrudes toward the second edge part, the second edge part has a recess part that accommodates the projection part, the metal annular shielding body further has an opening part between the projection part and the recess part, and the opening part is filled with a part of the resin member.

12. The connector device according to claim 10, wherein the metal annular shielding body further includes:

a connection end opposite to the seating part; and a plurality of terminal parts that protrude in an axis direction from the connection end and are at intervals in the first circumferential direction, and the first connector further includes:

a shielding structure fixed to the seating part; and a plurality of engaging parts that engages the plurality of terminal parts.

13. A coaxial connector, comprising:

a connector body having a cylindrical body, wherein the coaxial connector is inserted into and extracted from a counter-side connector, the counter-side connector has a plurality of elastic parts along a circumferential direction of an inner peripheral surface, the cylindrical body has an outer peripheral surface fitted into the inner peripheral surface, a plurality of locking groove parts on the outer peripheral surface, the outer peripheral surface is different from the inner peripheral surface, the plurality of locking groove parts holds the plurality of elastic parts, a plurality of unlocking parts on the outer peripheral surface, the plurality of locking groove parts and the plurality of unlocking parts in a circumferential direction of the outer peripheral surface, the plurality of locking groove parts is in a positional displacement from the plurality of unlocking parts, the plurality of elastic parts deforms elastically in a radial direction of the cylindrical body based on rotation in the circumferential direction of the cylindrical body between the plurality of locking groove parts and the plurality of unlocking parts.

14. A coaxial connector, comprising:

a connector body having a cylindrical body, wherein the coaxial connector is inserted into and extracted from a counter-side connecter, the counter-side connecter comprises a plurality of locking groove parts and a plurality of unlocking parts, in a circumferential direction of an outer peripheral surface, the plurality of locking groove parts is in a positional displacement from the plurality of unlocking parts, the cylindrical body has an inner peripheral surface fitted into the outer peripheral surface, a plurality of elastic parts on the inner peripheral surface, the inner peripheral surface is different from the outer peripheral surface, the plurality of elastic parts is held by the plurality of locking groove parts, respectively, the plurality of elastic parts is configured to deform elastically in a radial direction of the cylindrical body based on rotation in a circumferential direction of the cylindrical body between the plurality of locking groove parts and the plurality of unlocking parts.

* * * * *